US005213933A

United States Patent [19]

Osaki et al.

[11] Patent Number: 5,213,933

[45] Date of Patent: May 25, 1993

[54] POSITIVELY CHARGEABLE MAGNETIC TONER, IMAGE FORMING PROCESS IMAGE FORMING APPARATUS, APPARATUS UNIT AND FACSIMILE APPARATUS

[75] Inventors: Ichirou Osaki; Keita Nozawa, both of Kanagawa; Kuniko Kobayashi, Tokyo; Masatsugu Fujiwara; Masayoshi Shimamura, both of Kanagawa, all of Japan

[73] Assignee: Canon Kabushiki Kaisha, Tokyo, Japan

[21] Appl. No.: 706,184

[22] Filed: May 28, 1991

[30] Foreign Application Priority Data

May 25, 1990 [JP] Japan ..... 2-135578

[51] Int. Cl.[5] ..... G03G 9/083

[52] U.S. Cl. ..... 430/106.6; 430/110; 355/251; 358/301

[58] Field of Search ..... 430/109, 110, 106.6; 355/251; 358/301

[56] References Cited

U.S. PATENT DOCUMENTS 4,535,048 8/1985 Inoue et al. ..... 430/106.6

4,554,233 11/1985 Hashimoto et al. ..... 430/106.6

4,737,432 4/1988 Tanaka et al. ..... 430/110

*Primary Examiner*—John Goodrow

*Attorney, Agent, or Firm*—Fitzpatrick, Cella Harper & Scinto

[57] ABSTRACT

A positively chargeable magnetic toner comprises positively chargeable magnetic toner particles having at least a binder resin, a magnetic substance and a charge controlling agent; wherein the binder resin contains (A) a vinyl polymer having carboxyl groups, acid anhydride groups, partial esters thereof or mixtures of the groups and having and an acid value of 5 to 30, and (B) a copolymer obtained by polymerizing at least a diolefin monomer and a vinyl monomer; and wherein the charge controlling agent contains (C) a quaternary ammonium salt and (D) a nigrosine dye or a triphenylmethane dye, the ratio by weight among the components (A), (B), (C) and (D) being within the range of (A):(B):(C):(D)=80 to 30:70 to 20:2.0 to 0.5: 2.0 to 0.1 relative to 100 parts of the total weight of the components (A) and (B). The present invention also provides an image forming process, an image forming apparatus and a facsimile apparatus, all of which use the positively chargeable magnetic toner.

185 Claims, 4 Drawing Sheets

POSITIVELY CHARGEABLE MAGNETIC TONER, IMAGE FORMING PROCESS IMAGE FORMING APPARATUS, APPARATUS UNIT AND FACSIMILE APPARATUS

BACKGROUND OF THE INVENTION

1. Field of the Invention and Related Art

The present invention relates to a toner used for developers for developing electrostatic images in electrophotography, electrostatic recording, electrostatic printing and the like. Particularly, the present invention relates to a positive chargeable magnetic toner which is positively charged in a direct or indirect electrophotographic developing method so as to visualize negative electrostatic images or visualize positive electrostatic images by reversal and, particularly, which exhibits good characteristics in a heated roll fixing method.

Examples of known electrophotographic methods include the methods disclosed in U.S. Pat. No. 2,297,691, Japanese Patent Publication Nos. 42-23910 and 43-24748. In general electrophotographic methods, an electrically latent image is formed on a photosensitive material by various means using photoconductive substances and then developed by using a toner to form a toner image which is transferred to a transfer material such as paper or the like as occasion demands and then fixed by heating, pressure, heating/pressure or solvent vapor to produce a copy.

Metals such as amorphous selenium, amorphous silicon and the like, and inorganic compounds such as zinc oxide, cadmium sulfide and the like are generally used as photosensitive materials. However, in recent years, organic photosemiconductors (OPC) containing azo or stilbene dye pigments have been increasingly used in the fields of low-speed machines and popular machines because of their good processability, low price and high safety. It is believed that such photosemiconductors were developed for the field of high-speed machines in anticipation that the durability and sensitivity of such machines would be improved.

Such organic photosemiconductors mainly comprise a photocarrier generating layer and a carrier transporting layer which is provided on the photocarrier generating layer for improving the resistance to wearing, protecting the photocarrier generating layer and improving the sensitivity. In the present situation, since most organic photosemiconductors contain hole transport-type substances and are thus negatively chargeable, electrophotography frequently requires positively chargeable toners.

An effective means for making a toner positively chargeable is to mix as a positive charge controlling agent a compound having an electron donating group in the toner. Examples of positive charge controlling agents that are frequently used include quaternary ammonium salts and nitrogen-containing organic dyes, and basic dyes and salts thereof. Examples of such substances include nigrosine dyes and triphenylmethane dyes. The positively chargeable controlling agents are generally used after they have been added to binder resins and then adjusted to appropriate grain sizes through a heat melting and kneading process, a grinding process and, if required, a classifying process.

However, the charge controlling agents that are generally used easily produce the phenomenon that the charge controllability is changed by a mechanical impact, friction and changes in environmental conditions such as temperature and humidity. If a toner containing a charge controlling agent of the type that is generally utilized is used for development in a copying machine, the toner sometimes deteriorates as the number of times of copying increases.

Particularly, when a dye-type charge controlling agent is used, the dye migrates from the inside of the toner to a charge applying member such as carriers or a development sleeve by virtue of friction, heat or pressure. This frequently causes difficulties in charging the toner, the occurrence of scattering of the toner and deterioration in quality of the image formed.

The positively chargeable magnetic toner also has difficulties in fixing an image.

Methods of fixing a toner image include the following various methods:

(1) a method of fixing an image to a material to which an image is fixed (referred to as "a fixing material" hereinafter) by heating and melting a toner using the heat radiated from a heater;

(2) a method of fixing to a fixing material by applying a pressure to a toner to fluidize it;

(3) a method of fixing to a fixing material by applying solvent vapor to a toner to melt it; and (4) a method of fixing to a fixing material by applying heat and a pressure to a toner to melt and fluidize it.

The fixing method (1) has a danger of clogging a fixing portion with the fixing material and producing a fire caused by the clogging. The fixing method (2) is not universal because a material for the toner is significantly limited. The fixing method (3) causes the contamination of the surrounding environment. Thus, the fixing method (4) is widely used in the present condition.

The heat/pressure fixing method (4) which uses a heated roll pressed on a toner image has the many advantages that heat can be effectively transmitted to the toner even by a heat source at a relatively low temperature, that the temperature can be easily controlled, and that the deformation of the toner is accelerated by applying a pressure at the same time as heat. However, the fixing method (4) has the following problems to be solved:

In the fixing method (4), since the surface of the heating pressure means such as the heated roller contacts with the toner image in a melted state under pressure, the method produces a so-called offset phenomenon in that the toner image is partially transferred to the surface of the fixing roller and retransferred to a subsequent fixing material, thereby staining the image. In the extreme case, the method produces a so-called winding phenomenon that the fixing material adheres to the heated roll, thereby breaking the fixing unit. In order to prevent the occurrence of this phenomenon, a separating claw for fixing is provided on a heated roll fixing unit so as to force the fixing material to separate from the heated roll. However, this method has the problem that, when the substance is strongly wound on the heated roll, the image on the material is damaged.

In the heat/pressure fixing method, it is therefore necessary that the adhesion of the toner to the heating pressure means is as small as possible.

Thus the surface of the fixing roll is generally made of a material such as silicone rubber, a fluorine resin or the like, which has excellent release properties and low surface energy, and is further coated with a liquid lubricant such as silicone oil or the like, which has good release properties. The effect of silicone oil is very effective for preventing the offset of the toner and the winding of the fixing material. However, the silicone oil has problems in that the use of the silicone oil causes the complication of the fixing unit and the occurrence of an oil stain on the fixing material and that the silicone oil is evaporated by heat and soils the inside of the machine, particularly a charged wire. There is thus a tendency to use no silicone oil or at least to limit the use of the silicone oil.

In order to improve the anti-offset properties of the toner itself, it is effective to restrain the elongation of the toner by increasing the elasticity of the toner in a melted state. It is effective for increasing the elasticity of the toner to add a rubber substance or form a gel by crosslinking.

In order to improve the release properties of the toner itself, it is effective to add wax to the toner. For example, polyolefin wax such as a low-molecular weight polyethylene, low-molecular weight polypropylene or the like, paraffin wax, wax composed of a long-chain fatty acid ester, amide wax or the like can be employed.

However, the above-described methods are ineffective for the positively chargeable toner and sometimes have adverse effects thereon. For example, a low-surface energy substance such as silicone rubber, fluorine resin or wax has the tendency that the negative chargeability is increased when the substance is charged. Therefore, when such a substance is used in the fixing roll, a so-called electrostatic offset phenomenon readily takes place in which the toner positively charged on the fixing material is electrostatically offset to the fixing roll. Since such a low-surface energy substance originally has low dispersibility and compatibility, when the low-surface energy substance is contained as a surface lubricant in the toner, the surface lubricant easily forms individual particles which are negatively charged to form electrostatic coagula with the positively chargeable toner, thereby producing black point stains on the image. The basic dye or quaternary ammonium salt contained as a positively chargeable controlling agent in the positively chargeable toner soils the silicone rubber of the fixing roll or reacts with the fluorine in the fluorine resin to cause the fixing roll to lose its release properties, elasticity and strength. There are many proposals for solving the above-described problems with respect to the development properties peculiar to the positively chargeable toner and with respect to fixing.

Japanese Patent Laid-Open Nos. 55-134861 and 56-65417 disclose toners each formed by using a binder resin having an acid value. In these documents, the intermolecular cohesion of the binder contained in the toner is increased by introducing an acid value in a binder resin chain so that the adhesive strength between the toner and the fixing paper is increased, and the interfacial tension between the toner and the fixing roll surface is increased. It is recognized that this method is effective for offset and blocking.

Japanese Patent Laid-Open Nos. 57-40264 and 62-21169 disclose combinations of a binder resin containing a thermoplastic resin having an acid group and a positively chargeable controlling agent. In these documents, the toner is stably positively charged by the ionic stability between the base of the charge controlling agent and the acid of the binder resin. However, this method has the problem that, when an acid value is introduced into the positively chargeable toner, the development properties and durability deteriorate. The negative chargeability is increased as the number of the acid value introduced into the toner binder is increased, resulting in the occurrence of a positive fog and a decrease in the image density during preservation. Thus this method cannot be easily effectively used.

Japanese Patent Laid-Open Nos. 57-119364 and 62-9358 disclose quaternary ammonium sulfate compounds and quaternary ammonium sulfonate compounds. In these documents, the reaction of a fixing roller comprising a vinylidene fluoride-hexafluoropropylene copolymer with a quaternary ammonium salt is controlled so as to prevent the deterioration of the heated roll. However, the quaternary ammonium salt functions as a weak positively chargeable controlling agent. When the toner is mixed with carrier particles having strong negative chargeability, the toner produces a tribo-charge sufficient for practical use, while when one-component toner is used without being mixed with carrier particles, sufficient contact between the toner and the fixing material cannot be easily provided, as compared with the case where the toner is mixed with carrier particles and used. There is thus the disadvantage that since the toner is insufficiently charged, the image density is decreased, and fogging is increased. Particularly, under environmental conditions of high temperature and high humidity, the image density is further decreased.

Attempts have been made to improve the controllability of a charge controlling agent by combining a quaternary ammonium salt with another positively chargeable controlling agent. For example, Japanese Patent Laid-Open No. 61-172155 discloses the combination of a quaternary ammonium salt and nigrosine or a positively chargeable thermoplastic resin. In this case, since the quaternary ammonium salt has only an auxiliary function, when a one-component magnetic toner which is not mixed with carrier particles is used, the amount of the other charge controlling component combined with the quaternary ammonium salt must be substantially equal to the required amount of the other charge controlling agent when it is singly used. In this case, there remains the danger of contaminating the charge applying member with nigrosine.

Japanese Patent Laid-Open Nos. 55-113054, 61-80261 and 62-9358 disclose toners each comprising a styrene-butadiene copolymer and a positively chargeable controlling agent. The introduction of a conjugated diolefin such as butadiene or the like into a molecular chain provides the toner with rubber elasticity and is thus effective for anti-offset properties and anti-winding properties. When a positively chargeable toner is used, such a conjugated diolefin has no hindrance but has the advantage that the toner tribo-charge rapidly rises. While when the toner is combined with a positively chargeable controlling agent and a conjugated diolefin, the toner tends to be excessively charged and has the problem with respect to its poor compatibility with other resins and chargeable controlling agents. Particularly, when the toner is used as a one-component magnetic toner without mixing with carrier particles, the magnetic substance has poor dispersibility, and thus fogging sometimes occurs.

SUMMARY OF THE INVENTION

Accordingly, it is an object of the present invention to provide a positively chargeable magnetic toner which has none of the above-described disadvantages.

Namely, the object of the present invention is to provide a positively chargeable magnetic toner having excellent anti-offset properties and anti-winding properties.

It is another object of the present invention to provide a positively chargeable magnetic toner which is not or only little changed in its performance during use for a long period of time and which has stable charge controllability.

It is still another object of the present invention to provide a positively chargeable magnetic toner which allows the formation of a clear image which has a high density and is not or only slightly fogged.

It is a further object of the present invention to provide a positively chargeable magnetic toner comprising positively chargeable magnetic toner particles having at least a binder resin, a magnetic substance and a charge controlling agent; wherein the binder resin contains (A) a vinyl polymer having polar functional groups selected from the group consisting of carboxyl groups, acid anhydride groups, partial esters of the carboxyl groups, partial esters of the acid anhydride groups or mixtures thereof, and having an acid value of 5 to 30, and (B) a copolymer obtained by polymerizing at least a diolefin monomer and a vinyl monomer, and the charge controlling agent contains (C) a quaternary ammonium salt and (D) a nigrosine dye or triphenylmethane dye, the ratio by weight of the components (A), (B), (C) and (D) being within the range of (A):(B): (C):(D)=80 to 30:70 to 20:2.0 to 0.5:2.0 to 0.1 relative to 100 parts of the total weight of the components (A) and (B).

IT is a still further object of the present invention to provide an image forming process comprising transferring a positively chargeable magnetic toner positively charged by friction with the tone supporting member and supported on the surface thereof to an electrostatic image holding member hodling an electrostatic image on the surface thereof in a developing section in which the electrostatic holding member and the toner supporting member are disposed at a predetermined distance; developing the electrostatic image by the positively chargeable magnetic toner to form a developed image; transferring the formed developed image to a recording material with the same polarity as that of the electrostaic image; and fixing the unfixed toner image on the recroding material by applying heat and pressure thereto to form a fixed toner image; wherein the positively chargeable magnetic toner comprises positiely chargeable magnetic toner particles having at least a binder resin, a magnetic substance and a charge controlling agent; wherein the binder resin contains (A) a vinyl polymer having polar functional groups selected from the group consisting of carboxyl groups, acid anhydride groups, partial esters of the carboxyl groups, partial esters of the acid anhydride groups or mixtures thereof, and having an acid value of 5 to 30, and (B) a copolymer obtained by polymerizing at least a diolefin monomer and a vinyl monomer, and the charge controlling agent contains (C) a quaternary ammonium salt and (D) a nigrosine dye or triphenylmethane dye, the ratio by weight among the components (A), (B), (C) and (D) being within the range of (A):(B):(C):(D)=80 to 30:70 to 20:2.0 to 0.5:2.0 to 0.1 relative to 100 parts of the total weight of the components (A) and (B).

It is another object of the present invnetion to provide an image forming apparatus comprising an electrostatic image holding member for holding an electrostatic image, charge means for charing the electrostatic image holding member, developing means for developing the electrostatic image held by the electrostatic image holding member, transfer means for transferring the image developed by the developing means to a recording material form the electrostatic image holding member, and fixing means for fixing to the recording material the unfixed toner image transferred to the recording material by applying heat and pressure thereto; wherein teh developing means comprises a positively chargeable magnetic toner comprising positively chargeable magnetic toner particles having at leat a binder resin, a magnetic substance and a charge controlling agent and a toner holding member for positively charging the positively charageable magentic toner by friction therewith, wherein the binder resin contains (A) a vinyl polymer having polar functional groups selected from the group consisting of carboxy groups, acid anhydride groups, partial esters of the carboxyl groups, partial esters of the acid anhydride groups or mixtures thereof, and having an acid value of 5 to 30, and (B) a copolymer obtained by polymerizing at least a diolefin monomer and a vinyl monomer, and the charge controlling agent contains (C) a quaternary ammonium salt and (D) a nigrosine dye or triphenylmethane dye, the ratio by weight of the components (A), (B), (C) and (D) being with the range of (A):(B): (C):(D)=80 to 30:70 to 20:2.0 to 0.5:2.0 to 0.1 relative to 100 parts of the total weight of the components (A) and (B).

A further object of the invention is to provide an apparatus unit comprising a developing means for developing an electrostatic image which is held by an electrostatic image holding member, integrally combined with at least one of the electrostatic image holding member and a charge means for charging the electrostatic image holding member; the apparatus unit being detachably mounted to an apparatus main body comprising transfer means for transferring the image developed by the developing means to a recording material from the electrostatic image holding member and fixing means for fixing to the recording material the unfixed toner image transferred to the recording material by applying heat and pressure thereto; wherein the developing means comprises a positively chargeable magnetic toner comprising positively chargeable magnetic toner particles having at least a binder resin, a magnetic substance and a charge controlling agent and a toner holding member for positively charging the positively chargeable magnetic toner by friction therewith, wherein the binder resin contains (A) a vinyl polymer having polar functional groups selected from the group consisting of carboxyl groups, acid anhydride groups, partial esters of the carboxyl and acid anhydride groups or mixtures thereof, and having an acid value of 5 to 30, and (B) a copolymer obtained by polymerizing at least a diolefin monomer and a vinyl monomer, and the charge controlling agent contains (C) a quaternary ammonium salt and (D) a nigrosine dye or triphenylmethane dye, the ratio by weight of the components (A), (B), (C) and (D) being within the range of (A):(B): (C):(D)=80 to 30:70 to 20:2.0 to 0.5:2.0 to 0.1 relative to 100 parts of the total weight of the components (A) and (B).

A still further object of the invention is to provide a facsimile apparatus comprising an electrophotographic apparatus comprising an electrostatic image holding member for holding an electrostatic image, a charge means for charging the electrostatic image holding member, a developing means for developing the electrostatic image held by the electrostatic image holding member, a transfer means for transferring the image developed by the developing means to a recording material from the electrostatic image holding member, and a fixing means for fixing to the recording material the unfixed toner image transferred to the recording material by applying heat and pressure; and a receiving means for receiving image information from a remote terminal; wherein the developing means comprises a positively chargeable magnetic toner comprising positively chargeable magnetic toner particles having at least a binder resin, a magnetic substance and a charge controlling agent and a toner holding member for positively charging the positively chargeable magnetic toner by friction therewith, wherein the binder resin contains (A) a vinyl polymer having polar functional groups selected from the group consisting of carboxyl groups, acid anhydride groups, partial esters thereof or mixtures thereof, and having an acid value of 5 to 30, and (B) a copolymer obtained by polymerizing at least a diolefin monomer and a vinyl monomer, and the charge controlling agent contains (C) a quaternary ammonium salt and (D) a nigrosine dye or triphenylmethane dye, the ratio by weight of the components (A), (B), (C) and (D) being within the range of (A):(B):(C):(D)=80 to 30:70 to 20:2.0 to 0.5:2.0 to 0.1 relative to 100 parts of the total weight of the components (A) and (B).

DETAILED DESCRIPTION OF THE INVENTION

Figure 1:
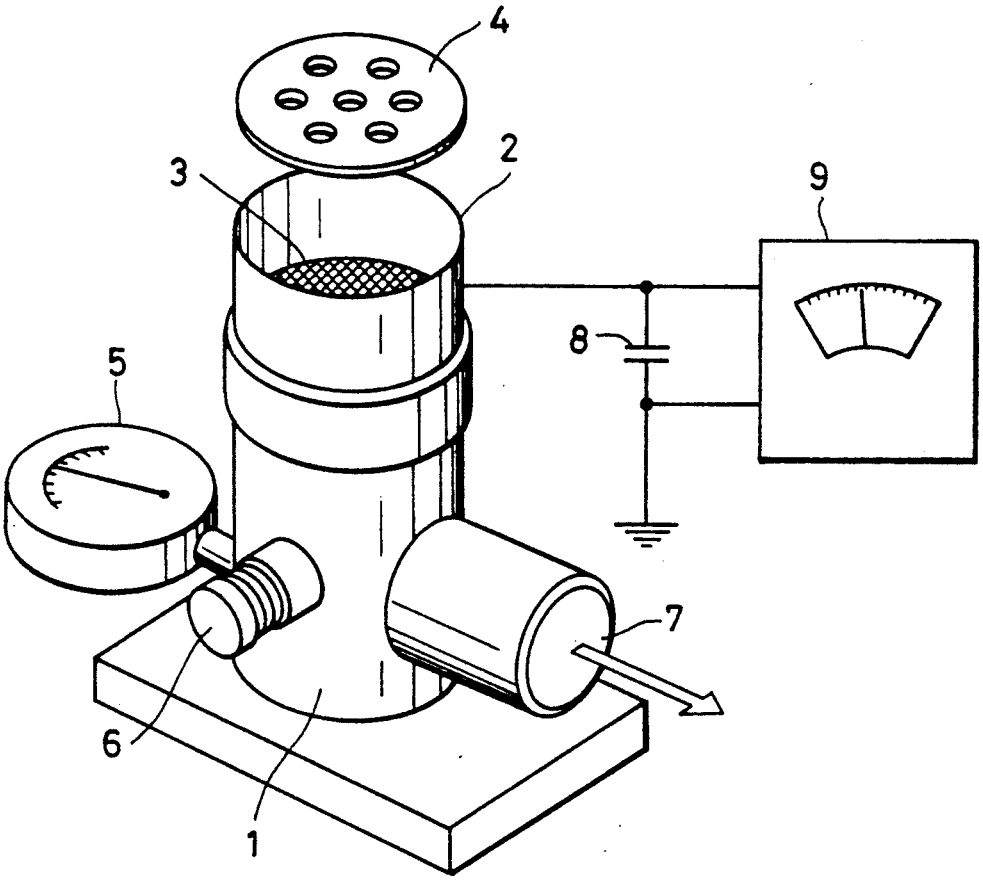
FIG. 1 is an explanatory view of an apparatus for measuring the tribo-charge amount of a toner in measurement of tribo-charge amounts.

As a result of energetic investigation conducted by the inventors with a view to achieving the objects, it was found that a positively chargeable magnetic toner comprising positively chargeable magnetic toner particles having excellent properties can be obtained by combining a specific toner binder resin with a plurality of specific positively chargeable controlling agents.

The binder resin in the present invention contains (A) a vinyl polymer having polar functional groups selected from the group consisting of carboxyl groups, acid anhydride groups, partial esters of the carboxyl or acid anhydride groups or mixtures thereof, and having an acid value of 5 to 30, and (B) a copolymer obtained by polymerizing at least a diolefin monomer and a vinyl monomer.

If the acid value is less than 5, there is the tendency that electrostatic offset and ground fogging are increased. If the acid value exceeds 30, there is the tendency that positive fog occurs, and the positive fog is significant under the conditions of high temperature and high humidity.

The charge controlling agent according to the present invention contains (C) a quaternary ammonium salt and (D) a nigrosine dye or a triphenylmethane dye.

It is also necessary that the components (A), (B), (C) and (D) which form the binder resin and the controlling agent, both of which are contained in the positively chargeable magnetic toner of the present invention, has a content ratio by weight in the toner particles within the range of (A):(B):(C):(D)=80 to 30:70 to 20:2.0 to 0.5:2.0 to 0.1 relative to 100 parts of the total weight of the components (A) and (B).

When the content of the component (A) of the components (A) and (B), which forms the binder resin, in the positively chargeable magnetic toner particles exceeds 80% by weight, much time is required for obtaining a predetermined image density, and the tendency of a fixing material to wind around a fixing roll increases. When the content of the component (A) of the components (A) and (B), which forms the binder resin, in the positively chargeable magnetic toner particles is less than 30% by weight, the surfaces of a toner holding member such as a sleeve for frictionally charging the toner and of the fixing roll are contaminated, and thus ground fogging easily occurs.

When the component ratio of one of the components (C) and (D) in the positively chargeable magnetic toner particles is greater than the upper limit of the above range, the toner adheres to the fixing roll and thus produces the offset phenomenon. Similarly, when the component ratio of one of the components is less than the lower limit of the range, the toner cannot be sufficiently charged.

The total of the components (C) and (D) is preferably 0.6 parts by weight or more relative to 100 parts of the total weight of the components (A) and (B) both of which form the binder resin contained in the positively chargeable magnetic toner particles. In this case, the toner can be sufficiently provided with chargeability.

A homopolymer containing as a monomer unit, for example, acrylic acid, methacrylic acid, maleic acid, itaconic acid, citraconic acid, dimethylmaleic acid, an acid anhydride thereof and/or a partial ester thereof, or a copolymer of at least one of the above monomers with at least one vinyl monomer can be used as the component (A) of the binder resin used in the present invention.

In the present invention, the acid value is measured in accordance with the Japanese Industrial Standard JIS K0076-66 "Method of Testing Acid Value of Chemicals".

A copolymer containing a vinyl monomer and as a monomer unit a diolefin such as butadiene, isoprene or chloroprene is used as the component (B) of the binder resin used in the present invention. Of these copolymers, a copolymer of styrene and butadiene is preferable. The ratio by weight of a diolefin to a vinyl monomer in a copolymer is preferably 90 to 80:10 to 20 from the viewpoint of compatibility with the component (A).

Examples of monomers that may be contained in the vinyl polymer for the components (A) and (B) contained in the binder resin used in the positively chargeable magnetic toner of the present invention include styrene and substitution products thereof such as P-chlorostyrene and vinyltoluene. Examples of other monomers include monocarboxylic acid derivatives each having a double bond such as ethyl acrylate, butyl acrylate, dodecyl acrylate, octyl acrylate, phenyl acrylate, methyl methacrylate, ethyl methacrylate, butyl methacrylate, butyl methacrylate, octyl methacrylate, acrylonitrile, methacrylonitrile and acrylamide; dicarboxylic acid derivatives each having a double bond such as butyl maleate, methyl maleate, octyl maleate and dimethyl maleate; vinyl esters such as vinyl chloride, vinyl acetate and vinyl benzoate; olefins such as ethylene, propylene and butylene; vinyl ketones such as vinyl methyl ketone and vinyl hexyl ketone; vinyl ethers such as vinyl methyl ether, vinyl ethyl ether and vinyl isobutyl ether; divinyl compounds such as divinyl benzene, divinyl naphthalene, ethylene glycol diacrylate, ethylene glycol dimethacrylate, 1,3-butanediol methacrylate, divinylaniline, divinylether, divinylsulfide and divinylsulfone. Polymers synthesized from the above monomers can be used singly or in a mixture thereof.

Polymers synthesized from the monomers below can be used as the binder resin in the present invention apart from the above-described polymers. Examples of such polymers include phenol resins, silicone resins, polyester resins, polyurethane resins, polyamide resins, furan resins, epoxy resins, xylene resins, polyvinyl butyral resins, terpene resins, cumarone-indene resins and petroleum resins.

Compounds that can be used as a quaternary ammonium salt for the component (C) of the charge controlling agent in the positively chargeable magnetic toner of the present invention have the following formulae (I) and (II):

Formula (I)

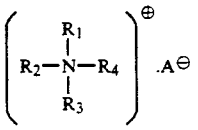

wherein $R_1$, $R_2$, $R_3$ and $R_4$ may be the same as or different from each other and are each an alkyl group having 1 to 30 carbon atoms, an aryl group which may have a substituent in the aromatic ring thereof or an aralkyl group ($-(CH_2)_n$ Ar, n=1 to 5, Ar=aryl group), and $A^-$ is an anion.

Examples of anions include halogen ions, sulfate ions, nitrate ions, borate ions, phosphate ions, organic sulfate ions, organic sulfonate ions, organic phosphate ions, polyacid ions, heteropolyacid ions, carboxylate ions and tetrafluoroborate ions.

Formula (II)

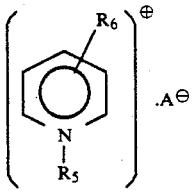

wherein $R_5$ is an alkyl group having 1 to 30 carbon atoms or an aralkyl group having 1 to 30 carbon atoms $-(CH_2)_n$Ar, n=1 to 5, Ar=aryl group), and $R_6$ is an alkyl group having 1 to 10 carbon atoms, and $A^-$ is an anion. Preferably, at least one $R_6$ group is present in the quaternary ammonium salt having the Formula (II).

Examples of anions include halogen ions, sulfate ions, nitrate ions, borate ions, phosphate ions, organic sulfate ions, organic sulfonate ions, organic phosphate ions, polyacid ions, heteropolyacid ions, carboxylate ions and tetrafluoroborate ions.

Typical examples of quaternary ammonium salts include the following compounds:

$(C_5H_{11})_4N^+.Br^-$ (1)

$(C_4H_9)_4N^+.I^-$ (2)

$(C_6H_{13})_4N^+.NO_3^-$ (3)

(4)

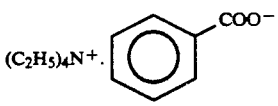

$(C_{16}H_{33})N^+.(CH_3)_3Cl^-$ (5)

$(C_{18}H_{37})_2N^+.(CH_3)_2Br^-$ (6)

(7)

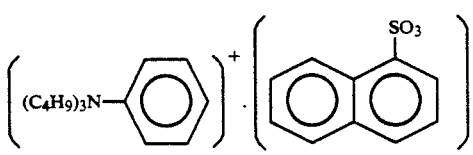

(8)

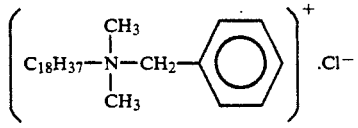

(9)

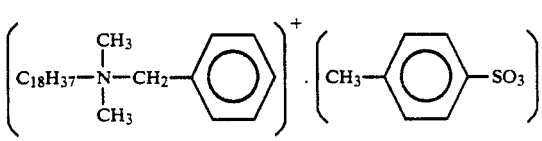

(10)

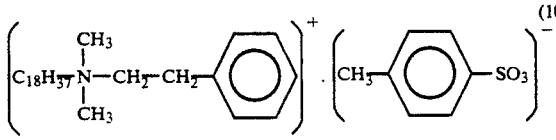

(11)

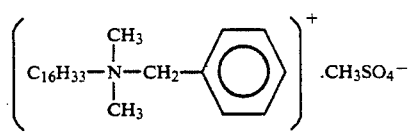

$C_{16}H_{33}N^+.(CH_3)_3$ 1/6 $[Mo_7O_{24}]^{6-}$ (12)

$C_{18}H_{37}N^+.(CH_3)_3$ 1/10 $[H_2W_{12}O_{42}]^{10-}$ (13)

(14)

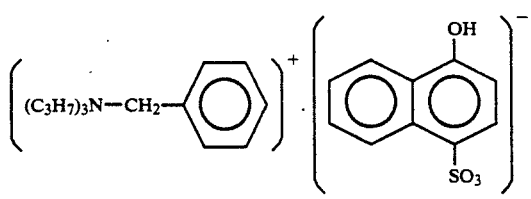

(15)

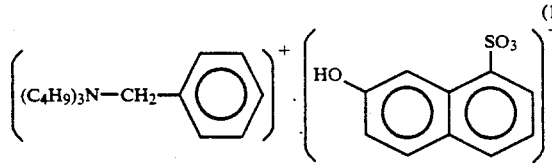

-continued (16)

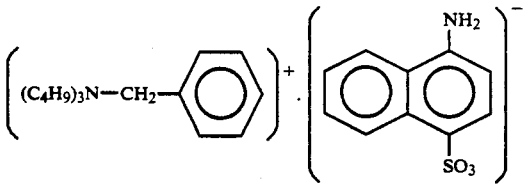

(17)

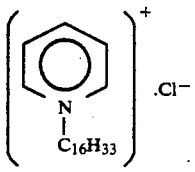

(18)

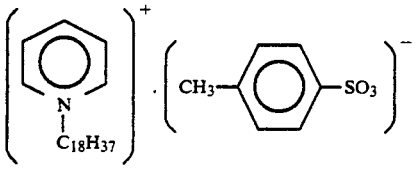

(19)

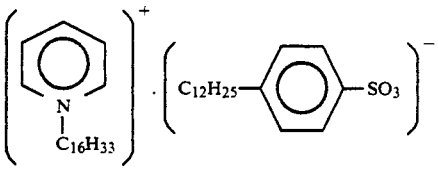

(20)

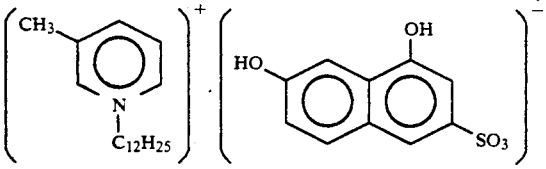

(21)

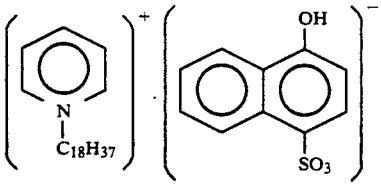

Examples of nigrosine dyes of triphenylmethane dyes, that are combined as the component (D) with the quaternary ammonium salt as the component (C) contained as the charge controlling agent in the postiively chargeable magnetic toner of the present invention, include nigrosine dyes which are oil-soluble or basic nitrogen-containing dyes, nigrosine dyes treated with an fatty acid, nigrosine dyes treated with a resin acid and triphenylmethane dyes expressed by the following formula (III):

Formula (III)

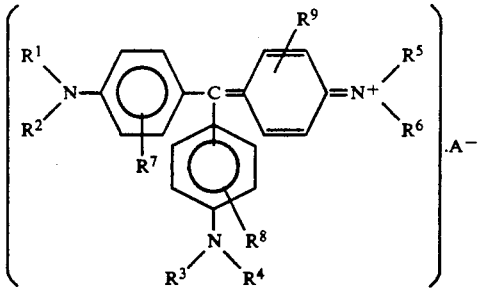

wherein $R^1$, $R^2$, $R^3$, $R^4$, $R^5$ and $R^6$ may be the same as or different from each other and are each a hydrogen atom, a substituted or unsubstituted methyl group or a substituted or unsubstituted aryl group; $R^7$, $R^8$ and $R^9$ may be the same as or different from each other and are each a hydrogen atom, a halogen atom, an alkyl group or an alkoxy group; and $A^-$ is anion such as a sulfate ion, a nitrate ion, a borate ion, a phosphate ion, a hydroxide ions, an organosulfate ions, organosulfonate ions, organophosphate ions, carboxylate ions, organoborate ions and tetrafluoroborate ions.

Typical examples of triphenylemthane dyes include the following compounds:

(1)

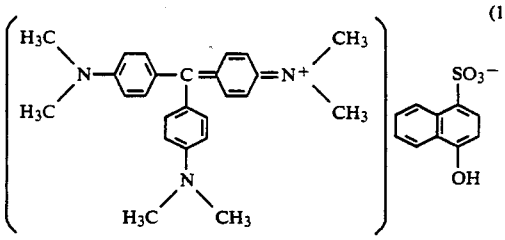

(2)

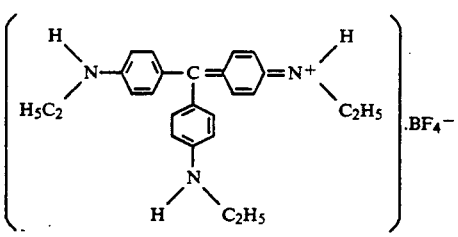

(3)

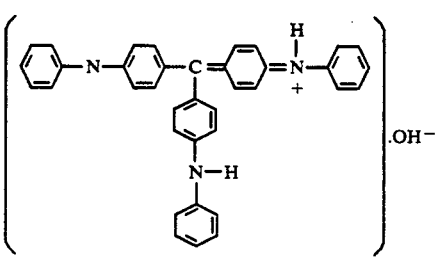

-continued (4)

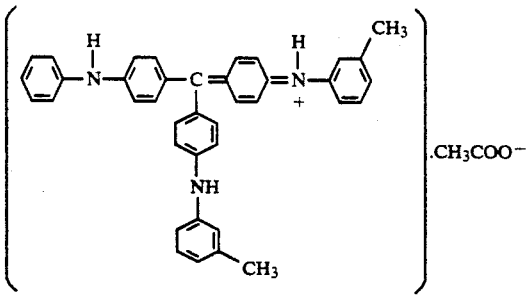

(5)

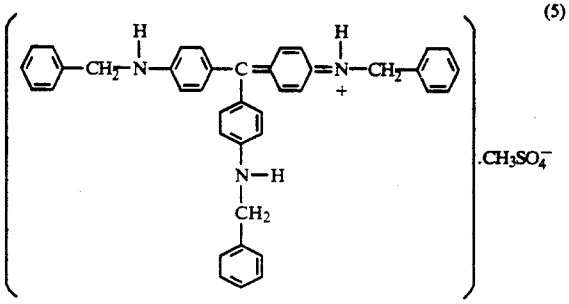

(6)

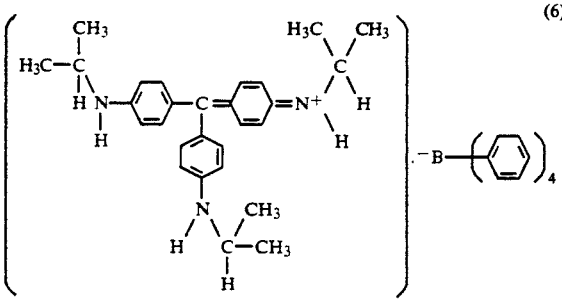

The positively chargeable magnetic toner of the present invention preferably comprises silica fine powder. When the positively chargeable magnetic toner of the present invention comprises silica fine power, since the silica fine powder is present between the tone particles and the sleeve surface, abrasion is significantly decreased. This permits an increase in the life of the positively chargeable magnetic toner and the sleeve and the toner to stably maintain the charageability. It is therefore possible to obtain a developer containing a positively chargeable magnetic toner exhibiting excellent charageability during use for a long time.

Although the silica fine powder produced by a dry method or a wet method can be used, the silica fine powder produced by a dry method is preferably used from the view point of filming resistance and durability.

The dry method is a method of producing silica fine powder by vapor phase oxidation of a silicon halide. For example, the method employs the pyrolytic oxidation reaction of silicon tetrachloride gas in the presence of oxygen and hydrogen. The basic reaction formula is as follows:

$$SiCl_4+2H_2+O_2\rightarrow 2SiO_2+4HCl$$

In the production process, another metal halide such as aluminum chloride or titanium chloride can be used together with the silicon halide to obtain composite fine power composed of silica and another metal oxide. The silicon halide used in the present invention includes such fine powder.

The wet method of producing the silica fine powder used in the positively chargeable toner of the present invention can be performed by various methods which are generally used. For example, the reaction formula of decomposition of sodium silicate with an acid is shown below.

$$Na_2O\cdot XSiO_2+2HCl+H_2O\rightarrow SiO_2\cdot nH_2O+NaCl$$

Examples of other wet methods include (1) a method of decomposing sodium silicate with an ammonia salt or an alkali salt to produce an alkali earth metal silicate from sodium silicate and then decomposing the silicate with an acid to form silicic acid; (2) a method of producing silicic acid from sodium silicate by using an ion exchange resin and (3) a method using natural silicic acid or silicate.

A silicate such as anhydrous silicon dioxide (silica), aluminum silicate, sodium silicate, potassium silicate, magnesium silicate or zinc silicate can be used as the silica fine powder.

The silica fine powder having a specific surface area of 30 $m^2/g$ or more (particularly, within the range of 5 to 400 $m^2/g$), which was measured by nitrogen adsorption in accordance with the BET method, produces good results. The silica fine power is preferably used in an amount of 0.01 to 8 parts by weight, more preferably 0.1 to 5 parts by weight, relative to 100 parts by weight of magnetic toner particles.

When the silica fine powder is added in an amount of 0.01 to 8 parts by weight relative to 100 parts by weight of positively chargeable magnetic toner particles, the toner exhibits an excellent effect. Particularly, when 0.1 to 5 parts by weight of silica fine powder is added, the toner can be stably provided with positively chargeability.

A preferable form of the silica fine powder is a state wherein 0.1 to 3 parts by weight of silica fine powder adheres to the surfaces of 100 parts by weight of positively chargeable magnetic toner particles.

The silica fine powder used for preventing the abrasion of the toner and the occurrence of stains on the surface of the sleeve is preferably positively chargeable rather than negatively chargeable because the charge stability of the toner is not deteriorated.

Examples of methods of producing the positively chargeable silica fine powder include a method of treating the untreated silica fine powder with silicone oil having organic groups each having in least one nitrogen atom at the side chain, a method of treating the powder with a nitrogen-containing silane coupling agent and a method of treating the powder with both agents.

The positively chargeable magnetic silica used in the present invention shows the positive tribo-charge relative to ion powder carriers in measurement by the blow-off method.

The silicone oil having nitrogen atoms in the side chains and used for treating the silica fine powder has at least the partial structure having the following formula:

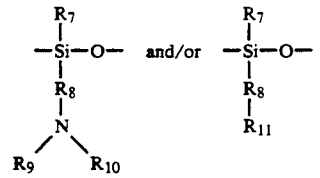

wherein $R_7$ is a hydrogen atom, an alkyl group, an aryl group or an alkoxy group; $R_8$ is an alkylene group or a phenyl group; $R_9$ and $R_{10}$ may be the same as or different from each other and are each a hydrogen atom, an alkyl group or an aryl group; and $R_{11}$ is a nitrogen-containing heterocyclic group. Each of the alkyl, aryl, alkylene and phenylene groups may have an organic group having a nitrogen atom or a substituent such as a halogen atom within the range which does not harm the chargeability.

The nitrogen-containing silane coupling agent used for treating the silica fine powder generally has the structure shown by the following formula:

$$(X)_m-Si-(Y)_n$$

wherein X is an alkoxy group or a halogen atom, Y is an amino group or an organic group having at least one nitrogen atom, and m and n are each an integer of 1 to 3 and satisfy the equation $m+n=4$.

Examples of organic groups having at least one nitrogen atom and used for treating the silica fine powder include amino groups each having an organic group as a substituent, nitrogen-containing heterocyclic groups and groups each having a nitrogen-containing heterocyclic group. The nitrogen-containing heterocyclic groups include unsaturated heterocyclic groups and saturated heterocyclic groups, and any one of known nitrogen-containing heterocyclic groups can be used. Typical examples of unsaturated heterocyclic groups include the following groups:

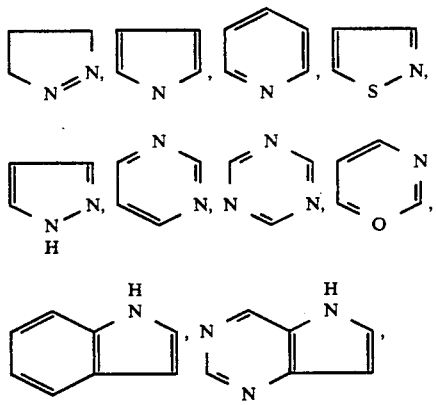

Typical examples of saturated heterocyclic groups include the following groups:

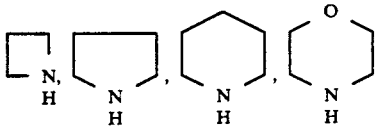

-continued

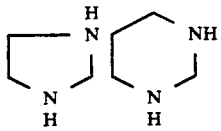

In the present invention, a five-member or six-member heterocyclic group is preferably used as the heterocyclic group in view of stability.

Typical examples of organic groups each having at least one nitrogen atom are given below.

Examples of amino groups each having an organic group as a substituent include aminopropyltrimethoxysilane, aminopropyltriethoxysilane, dimethylaminopropyltrimethoxysilane, diethylaminopropyltrimethoxysilane, dipropylaminopropyltrimethoxysilane, dibutylaminopropyltrimethoxysilane, monobutylaminopropyltrimethoxysilane, dioctylaminopropyltrimethoxysilane, dibutylaminopropyldimethoxysilane, dibutylaminopropylmonomethoxysilane, dimethylaminophenyltriethoxysilane, trimethoxysilyl-γ-propylphenylamine and trimethoxysilyl-γ-propylbenzylamine.

Examples of nitrogen-containing heterocyclic groups and groups each containing a nitrogen-containing heterocyclic group include trimethoxysilyl-γ-propylpiperidine, trimethoxysilyl-γ-propylmorpholine and trimethoxysilyl-γ-propylimidazole.

If required, the silica fine powder used in the present invention can be treated by reaction or physical adsorption using a treatment agent such as a silane coupling agent, silicone oil or an organosilicon compound for the purpose of making the powder hydrophobic.

Examples of such silane coupling agents and organosilicon compounds used for making the silica fine powder hydrophobic include hexamethyldisilane, vinyltrimethoxysilane, vinyltriethoxysilane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethylchlorosilane, α-chloroethyltrichlorosilane, β-chloroethyltrichlorosilane, chloromethyldimethylchlorosilane, triorganosilylmercaptan, trimethylsilylmercaptan, triorganosilylacrylate, vinyldimethylacetoxysilane, dimethylethoxysilane, dimethyldimethoxysilane, diphenyldiethoxysilane, hexamethyldisiloxane, 1,3-diphenyltetramethyldisiloxane, and dimethylpolysiloxane having 2 to 12 siloxane units per molecule and containing a hydroxyl group linked to one Si in each of the terminal units.

The silicone oil used for making the silica fine powder hydrophobic has the following general formula:

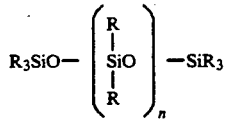

wherein R is a hydrogen atom, an alkyl group, an aryl group, an alkoxy group, a phenylene group, an alkylene group, a carboxyl group, a halogenide thereof or an etherified compound thereof.

Such silicone oil preferably has a viscosity of about 5 to 5000 centistoke at 25° C. Examples of such silicone oils include methyl silicone oil, dimethyl silicone oil, phenylmethyl silicone oil, chlorophenylmethyl silicone oil, alkyl-modified silicone oil, fatty acid-modified silicone oil, polyoxyalkylene-modified silicone oil.

The above-described treating agents can be used singly or in mixture of two or more agents.

The positively chargeable magnetic toner of the present invention preferably further comprises fine power of a fluorine-containing polymer such as polytetrafluoroethylene, polyvinylidene fluoride, or tetrafluoroethylene-vinylidene fluoride copolymer. Of these polymers, polyvinylidene fluoride fine powder is preferable from the viewpoints of fluidity and abrasion properties. The fluorine-containing polymer fine powder is preferably added in an amount of 0.01 to to 2.0 parts by weight, more preferably 0.02 to 1.0 parts by weight, based on 100 parts by weight of toner particles.

Although the reasons are not clear, the positively chargeable magnetic toner comprising the positively chargeable magnetic toner particles, the silica fine powder and the fluorine-containing polymer fine powder stabilizes the state wherein the silica fine powder adheres to the toner particles. For example, there is thus no phenomenon that the silica fine powder adhering to the toner particles is separated therefrom, thereby decreasing the effect of preventing the abrasion of the toner and the occurrence of stains on the sleeve. In addition, the charge stability of the toner can be further increased.

The positively chargeable magnetic toner of the present invention may contain other additives as occasion demands. Examples of other additives include an abrasive such as cerium oxide or silicon carbide, a fluidity-adding and caking inhibitor such as aluminum oxide, and a conductivity adding agent such as carbon black or tin oxide.

The positively chargeable magnetic toner of the present invention may contain a wax substance such as low-molecular weight polyethylene, low-molecular weight polypropylene, microcrystalline wax, carnauba wax, sasole wax, or paraffin wax for the purpose of improving release properties during fixing by the heated roll. The wax substance is preferably added to the insides of the positively chargeable magnetic toner particles.

Examples of magnetic substances that can be used in the positively chargeable magnetic toner of the present invention include ion oxides such as magnetite; ion oxides containing other metal oxides such as ferrite; metals such as Fe, Co and Ni; alloys thereof with metals such as Al, Co, Cu, Pb, Mg, Ni, Sn, Zn, Sb, Be, Bi, Cd, Mn, Se, Ti, W or V; and mixtures thereof.

The magnetic substance preferably has an average particle size of about 0.1 to 2 μm and such magnetic properties at 10 KOe that the magnetic force resistance is from 20 to 150 Oe, the saturation magnetization is from 50 to 200 emu/g (more preferably 50 to 100 emu/g) and the residual magnetization is from 2 to 20 emu/g.

The magnetic substance is preferably contained in the positively chargeable toner particles in an amount of 20 to 150 parts by weight, more preferably 40 to 120 parts by weight, relative to 100 parts by weight of the total of the components (A) and (B) of the binder resin.

In the present invention, the term "positively chargeable magnetic toner" represents a toner showing the positive tribo-charge with respect to iron powder carriers in measurement by the blow-off method.

The measurement method employed in the present invention is described below.

Measurement of Tribo-Charge Amount

The measurement method is described in detail below with reference to the drawings.

FIG. 1 is an explanatory view of an apparatus for measuring the tribo-charge amounts of the toner and silica. About 0.5 to 1.5 g of sample to be measured with respect to its tribo-charge amount is placed in a measuring metal container 2 having a 500-mesh screen 3 at the bottom thereof, and then a metal cover 4 is placed on the container 2. The sample comprises a mixture containing a toner and iron powder carriers in a ratio by weight of 1:9 or a mixture (developer) obtained by shaking with the hand for about 10 to 40 seconds a polyethylene bottle having a volume of 50 to 100 ml and containing a mixture of silica and iron powder carrier in a ratio by weight of 1:99. The total weight $W_1$ (g) of the measuring container 2 is then measured. The pressure of a vacuum gauge 5 is then adjusted to 250 mmAq by suction through a suction hole 7 while adjusting an airflow control value 6 in an aspirator 1 (at least an insulator contacts with the measuring container 2). In this state, the toner or silica is removed by suction for sufficient time, preferably 2 minutes. At the same time, the potential V (volt) of an electrometer 9 is measured. In the drawing, reference numeral 8 denotes a capacitor having a capacity C (μF). After the suction, the total weight $W_2$ (g) of the measuring container 2 is measured. U The tribo-charge amount (μc/g) of the toner or silica is calculated by the following equation:

$$\text{Tribo-charge amount of toner or silica } (\mu c/g) = \frac{C \times V}{W_1 - W_2}$$

The measurement conditions are that the temperature and humidity are respectively 23° C. and 60% RH, and iron powder carriers EFV200/300 (manufactured by Powdertec Corp.) is used in the measurement.

Figure 2:
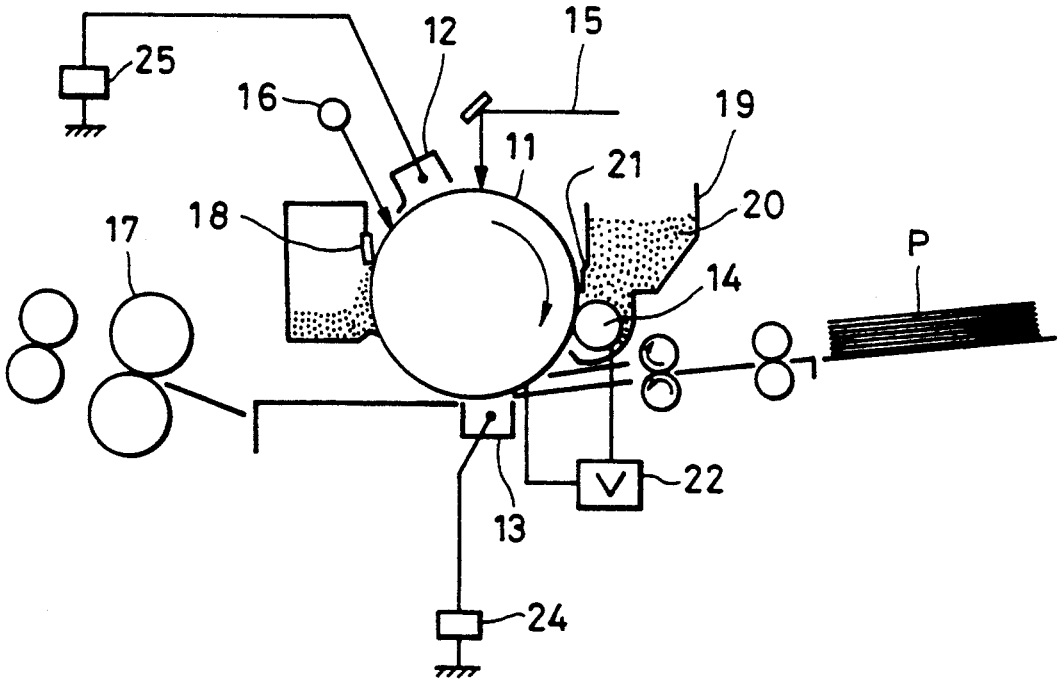
FIG. 2 is a schematic drawing of the arrangement for explaining an image forming method and an image forming apparatus in accordance with the present invention.
Figure 3:
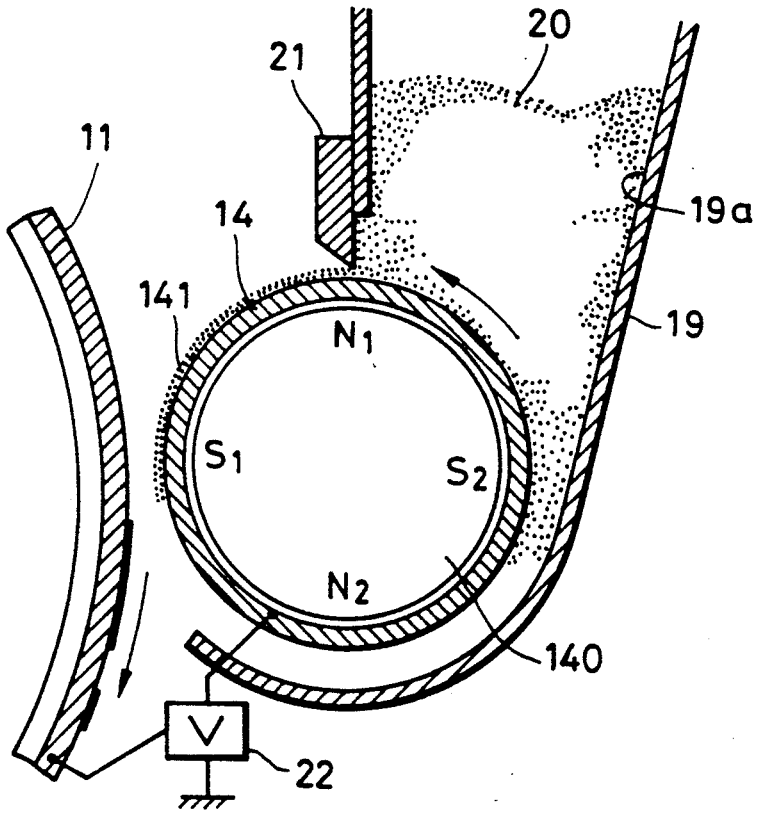
FIG. 3 is a partially enlarged view of the arrangement shown in FIG. 2 for explaining the development process.

The image forming method and image forming apparatus of the present invention are described below with reference to FIGS. 2 and 3.

In the drawings, reference numeral 12 denotes a charger serving as charge means for charging a photosensitive drum 11 serving as an electrostatic image holding member. Reference numeral 25 denotes a source section for applying a voltage to the charger 12, which applies a predetermined voltage to the charger 12. Reference numeral 13 denotes a transfer charger serving as transfer means to which a predetermined bias is applied from a constant-voltage source 24. Preferable bias conditions are that a current value is 0.1 to 50 μA, and a voltage value (absolute value) is 500 to 4000 V.

The surface of an OPC photosensitive substance is, for example, negatively charged by the charger 12 serving as the charge means and having the source section (voltage applying means) 25 to form an exposed electrostatic latent image. The latent image is developed by a positively chargeable magnetic toner 20 of the present invention which is contained in a developing unit 19 equipped with an iron magnetic blade 21 and a non-magnetic developing sleeve 14 containing a magnet 140 and serving as a toner holding member. A sleeve made of stainless steel (SUS304) and having a diameter of 50 mm and a plurality of spherical dents is used as the developing sleeve 14. In the developing section, an a.c. bias, pulse bias and/or d.c. bias is applied between the conductive base of the photosensitive drum 11 and the developing sleeve 14 from bias applying means 22. When transfer paper P is conveyed to the transfer section, the transfer paper P is charged from the rear side thereof (the side opposite to the side of the photosensitive drum) by the charge applying means 24 through the transfer charger 13 so that the developed image (toner image) on the surface of the photosensitive drum 11 is electrostatically transferred to the transfer paper P. The transfer paper P separated from the photosensitive drum 11 is subjected to fixing for fixing the toner image to the transfer paper P by a heat/pressure roller fixing unit 17.

The positively chargeable magnetic toner 20 remaining on the photosensitive drum 11 after the transfer process is removed by a cleaning unit 18 having a cleaning blade. After the cleaning process, the photosensitive drum 11 is destaticized by erase exposure 16, and the processes starting from the charge process using the charger 12 are then repeated over again.

The photosensitive drum 11 has the OPC photosensitive layer and the conductive base and is moved in the direction shown by the arrow. The non-magnetic cylindrical developing sleeve 14 serving as the toner holding member is rotated so as to move in the same direction as that of the surface of the photosensitive drum 11 in the developing section. A multipolar permanent magnet 140 (magnet roll) serving as field generating means is disposed in the developing sleeve 14 so as not to rotate. The multipolar permanent magnet 140 is preferably set so that the magnetic pole $N_1=500$ to 900 gauss, the magnetic pole $N_2=600$ to 1100 gauss, the magnetic pole $S_1=800$ to 1500 gauss and the magnetic pole $S_2=400$ to 800 gauss. The positively chargeable magnetic toner 20 contained in the developing unit 19 is coated to the developing sleeve 14 and provided with the positive tribo-charge by friction between the surface of the developing sleeve 14 and the positively chargeable magnetic toner 20. In addition, the iron magnetic doctor blade 21 is disposed near the cylindrical surface of the developing sleeve 14 (at a distance of 50 μm to 500 mm) and opposite to one polar position of the multipolar permanent magnet 140 so that the thickness of the toner layer is made thin (30 to 300 μm) and uniform. This enables the formation of the toner layer which does not contact the photosensitive drum 11 and which has a thickness smaller than the gap between the photosensitive drum 11 and the developing sleeve 14 in the developing section. The rotational speed of the developing sleeve 14 is adjusted so that the surface speed of the developing sleeve 14 is substantially equal or close to the surface speed of the photosensitive drum 11. A permanent magnet may be used as the iron magnetic doctor blade 21 to form a counter magnetic pole. An a.c. bias or pulse bias may be applied between the surfaces of the developing sleeve 14 and of the photosensitive drum 11 from the bias source 22 serving as bias means in the developing section. Preferable bias conditions are such that Vpp is 1500 to 2300 V and f is 900 to 1600 Hz in the case of an a.c. bias and that DC is −100 to −350 V in the case of a d.c. bias. During transfer of the toner 20 in the developing section formed in the portion where the developing sleeve (toner holding member) 14 is most near the photosensitive drum 11 and the vicinity thereof, the toner 20 is transferred to the photosensitive drum 11 by the electrostatic force possessed by the electrostatic image holding surface of the photosensitive drum 11 and the a.c. bias or pulse bias applied, while reciprocating between the developing sleeve 14 and the photosensitive drum 11.

An elastic blade made of an elastic material such as silicone rubber may be used in place of the magnetic doctor blade 21 so that the thickness of the toner layer can be controlled by pressing the elastic blade on the surface of the photosensitive drum 11 to form the toner layer having a predetermined thickness on the developing sleeve 14.

An electrostatic recording insulating drum or a photosensitive drum having a layer of a photoconductive insulating substance such as α-Se, CdS, $ZnO_2$ or α-Si can be appropriately selected and used as the photosensitive drum 11 in place of the OPC photosensitive drum according to the development conditions.

The image forming apparatus may comprise an apparatus unit in which a plurality of components selected from the photosensitive drum (electrostatic image holding member), the developing means, the charge means and the cleaning means are integrally combined and which is detachably mounted to the apparatus main body. For example, at least one of the charge means, the developing means and the cleaning means may be supported integrally with the photosensitive drum to form a unit which is detachably fitted to the apparatus body by using guide means such as a rail or the like. In this case, the apparatus unit may comprise the charge means and/or the developing means.

When the image forming apparatus of the present invention is used as a printer for a facsimile apparatus, image exposure 15 is digital exposure for printing received data by using a laser beam. An example of such a printer is shown by the block diagram in FIG. 4.

A controller 211 controls an image reading section 210 and a printer 219. The whole controller 211 is controlled by CPU 217. The data read from the image reading section is sent to a remote terminal through a transmitting circuit 213. The data received from the remote terminal is sent to the printer 219 through a receiving circuit 212. Predetermined image data is stored in an image memory. A printer control controls the printer 219. Reference numeral 214 denotes a telephone.

The image (image information from a remote terminal connected through a line) received through a line 215 is demodulated by the receiving circuit 212, decoded in the CPU 217 and then successively stored in the image memory 216. When the image on at least one page is stored in the memory 216, the image on that page is recorded. The CPU 217 reads the image information on one page from the memory 216 and sends the decoded image information of the page to the printer controller 218. When the printer controller 218 receives the image information on one page from the CPU 217, the printer controller 218 controls the printer 219 to record the image information of that page.

The CPU 217 receives image information on the next page during recording by the printer 219.

In this way, an image is received and recorded.

The positively chargeable magnetic toner of the present invention having the above-described composition exhibits excellent anti-offset properties and anti-winding properties has stable charge controllability even during use for a long time and enables the formation of a clear image having a high density and no fog.

EXAMPLES

Although the present invention is described in detail below with reference to the examples below, the present invention is not limited to these examples. In the examples, "parts" represents "parts by weight".

Example 1

| | |
|---|---|
| Styrene/n-butyl acrylate/n-butyl maleate/divinylbenzene copolymer (component ratio by weight = 74.5/22.0/3.0/0.4, acid value = 9.5, Mw = 330,000) | 60 parts |
| Low-molecular weight polyethylene (Mw = 1300) | 4 parts |
| Styrene/butadiene/divinylbenzene copolymer (component ratio by weight = 86/14/0.4) | 40 parts |
| Magnetic iron oxide | 70 parts |
| Quaternary ammonium salt (charge controlling agent) | 1 part |

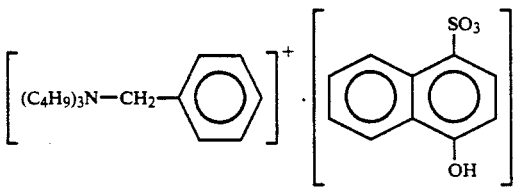

| | |
|---|---|
| Nigrosine dye (charge controlling agent) | 0.5 part |

The above materials were mixed well by a Henschel mixer and then kneaded by an extruder set at 100° C. The thus-kneaded mixture was then roughly ground by a cutter mill and then finely ground by a jet mill which used a jet stream. The thus-finely ground particles were classified by a pneumatic classifier to obtain black fine powder (positively chargeable magnetic toner particles) having an average particle size of 12.5 μm. The thus-obtained magnetic toner particles had a tribo-value of +7.5 μc/g. 0.4 part of positively chargeable hydrophobic dry silica (BET specific surface area: 130 $m^2/g$) which was treated with amino-modified silicone oil (viscosity at 25° C.: 100 cp, amine equivalent: 800) and 0.2 parts of spherical polyvinylidene (PVDF) particles were added to 100 parts of the obtained positively chargeable magnetic toner particles. The resultant mixture was then mixed by using a Henschel mixer to obtain a magnetic toner. The thus-obtained magnetic toner had a tribo-value of +6.0 μc/g.

Figure 4:
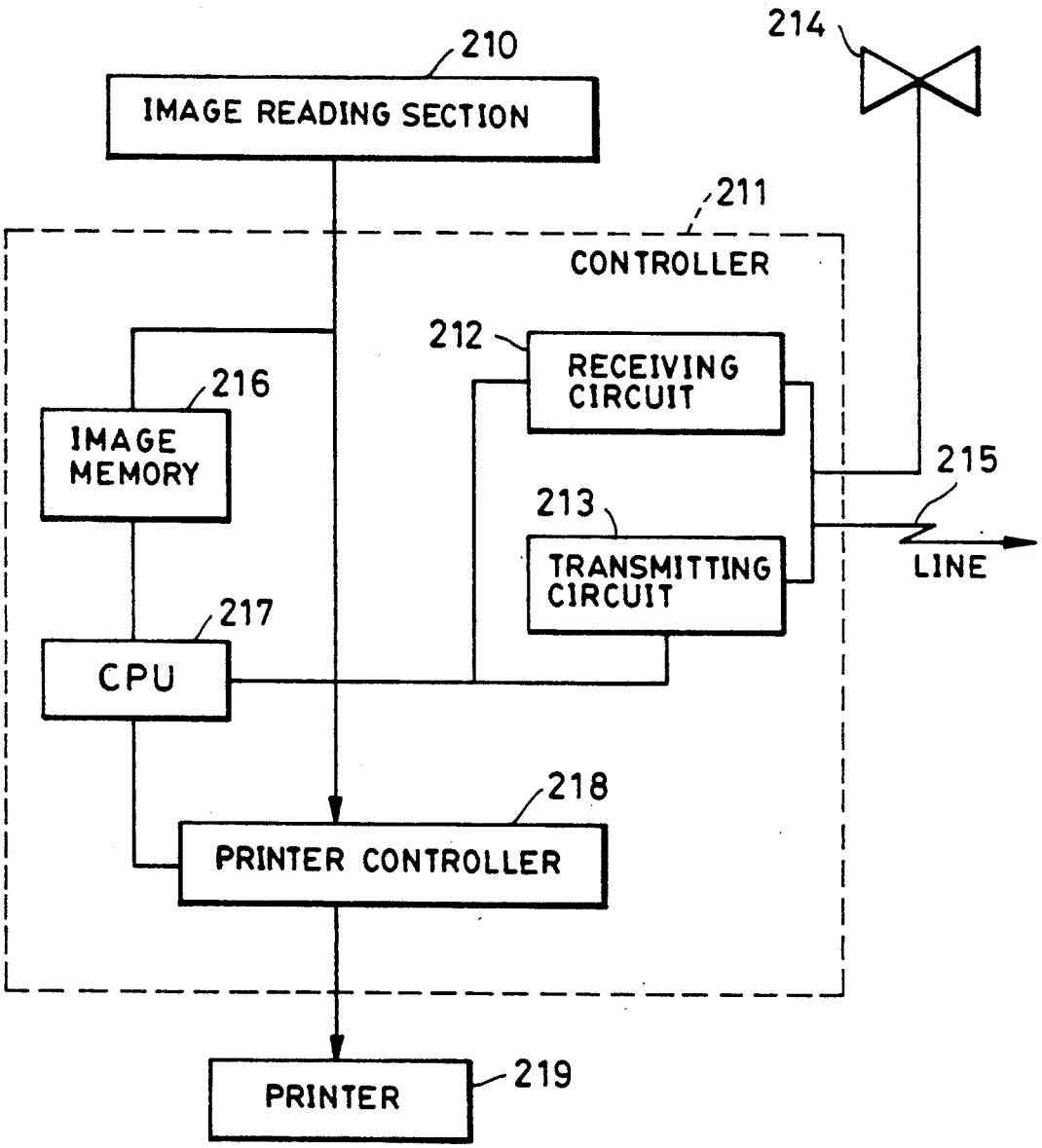
FIG. 4 is a block diagram of a facsimile apparatus using as a printer an electrophotographic apparatus.

As a result of copying by using the positively chargeable magnetic toner and an electron copying machine NP-5540 (manufacture by Canon Corp.) as shown in FIG. 4, which was commercially available, the image density was 1.35 in an early stage and did not change after copying on 100,000 sheets of paper.

The development conditions were as follows:

Bias conditions in developing section: a.c. voltage=1500 Vpp, a.c. frequency=1600 Hz, d.c voltage=250 V Distance between magnetic blade and toner holding member: 250 μm Thickness of toner layer on toner holding member: about 180 μm Bias conditions in transfer means: current value=400 mA, voltage=−5.6 kV Magnetic force conditions of magnet in toner holding member: $N_1$=820 gauss, $N_2$=600 gauss, $S_1$=700 gauss, $S_2$=600 gauss Process speed: 40 sheets/minute No fog was observed in both the background portion and the reverse portion (a portion of the photosensitive drum having a light-portion negative potential which is lower than that of a usual white portion of the photosensitive drum because strong auxiliary light is partially applied to the drum for performing multiple copying), and scattering slightly occurred. Under low-humidity conditions when the temperature was 15° C. and the humidity was 10% RH and high-humidity conditions when the temperature was 32.5° C. and the humidity was 85% RH, the image density was 1.3 or more, and good results were obtained.

The surface of the heated roll made of PFA (perfluoroalcoholate) was not stained, and the image formed was not stained by offset. Although a black solid image was formed and fixed, jamming was not caused by winding of the recording material around the heated roll by virtue of the strong adhesive force. In addition, no scar was produced on the image formed by the fixing separating claw which was provided on the heated roll fixing unit.

Example 2

The materials used were the same as those used in Example 1 with the exception that the combination of the charge controlling agents used in Example 1 was changed to the combination below.

| | |
|---|---|
| Quaternary ammonium salt (charge controlling agent) | 1.5 parts |

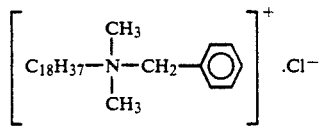

| | |
|---|---|
| Basic triphenylmethane dye (charge controlling agent) | 2.0 parts |

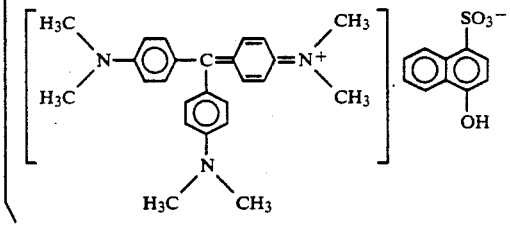

The thus-obtained magnetic toner particles had a tribo-value of +10.0 mc/g, and the obtained magnetic toner comprising the positively chargeable hydrophobic dry silica and spherical polyvinylidene fluoride particles had a tribo-value of +9.5 μc/g.

As a result of copying on 100,00 sheets under the environmental conditions that the temperature and humidity were respectively 23° C. and 60% RH, 32.5° C. and 85% RH and 15° C. and 10% RH, the image density was constantly 1.30 or more, and no fogging was observed. Neither offset of the image nor stain on the fixing roll was observed. The anti-winding properties were also good.

Example 3

| | |
|---|---|
| Styrene/2-ethylhexyl acrylate/n-butyl maleate/divinylbenzene copolymer (component ratio by weight = 70/27.7/1.5/0.8, acid value = 5, Mw = 380,000) | 70 parts |
| Styrene/butadiene copolymer (component ratio by weight = 85/15) | 30 parts |
| Low-molecular weight propylene/ethylene copolymer (Mw = 6000) | 4 parts |
| Magnetic iron oxide powder | 60 parts |
| Quaternary ammonium salt (charge controlling agent) | 0.6 part |
| 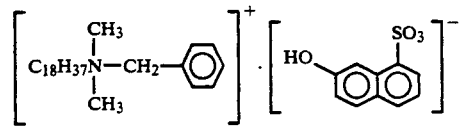 | |
| Nigrosine dye (charge controlling agent) | 1.0 part |

Magnetic toner particles were formed by the same method as that employed in Example 1 with the exception that the above materials were used. The obtained magnetic toner particles had a tribo-value of +9.0 μc/g, and the magnetic toner obtained comprising positively chargeable hydrophobic dry silica and spherical polyphenylidene particles had a tribo-value of 30 7.5 μc/g. As a result of copying on 100,000 sheets under the conditions that the temperature and humidity were respectively 23.5° C. and 60% RH, 32.5° C. and 85% RH and 15° C. and 10% RH, the image density was constantly 1.30 or more, and no fogging was observed. Neither offset to the images nor stain on the fixing roll were observed. In addition, anti-winding properties was good.

Example 4

Magnetic toner particles were formed by the same method as employed in Example 1 with the exception that the copolymer ratio by weight of the styrene/-butadiene/divinylbenzene copolymer used in Example 1 was changed to 30/70/0.4. The thus-obtained magnetic toner particles had a tribo-value of +8.0 μc/g, and the magnetic toner obtained comprising positively chargeable hydrophobic silica and spherical polyvinylidene fluoride particles had a tribo-value of +7.0 μc/g. As a result of copying on 100,000 sheets under the conditions that the temperature and humidity were respectively 23.5° C. and 60% RH, 32.5° C. and 85% RH and 15° C. and 10% RH, the image density was constantly 1.30 or more, and no fogging was observed. Neither offset to the images nor stain on the fixing roll was observed. In addition, anti-winding properties were good.

Comparative Example 1

Magnetic toner particles were formed by the same method as that employed in Example 1 with the exception that no styrene/butadiene copolymer was used, and 100 parts of vinyl copolymer having an acid value was used. The thus-obtained magnetic toner particles had a tribo-value of +7.5 μc/g, and the obtained magnetic toner comprising positively hydrophobic dry silica and spherical polyvinylidene fluoride particles had a tribo-value of +5.5 μc/g.

Although the initial image density was less than 1.00 and reached 1.25 after images had been printed on 1,000 sheets of paper, significant fogging occurred in the reverse portions. When images were printed on 1,000 sheets under the environmental conditions that the temperature and humidity were respectively 32.5° C. and 85% RH, the image density was less than 1.10. When images were printed on 1,000 sheets under the environmental conditions that the temperature and humidity were respectively 15° C. and 10% RH, significant fogging occurred over the whole image.

Although offset to the image formed was negligible, the force of winding on the fixing roll was strong, and a scar was produced on the image formed by the fixing separating claw provided on the heated roll fixing unit.

Comparative Example 2

Magnetic toner particles were produced by the same method as that employed in Example 1 with the exception that the copolymer below was used in place of the vinyl polymer having an acid value and used in Example 1.

| | |
|---|---|
| Styrene/n-butyl acrylate/divinylbenzene copolymer (component ratio by weight = 77.5/22.0/0.4, acid value = 0, Mw = 320,000) | 60 parts |

The obtained magnetic toner particles had a tribo-value of +11.0 μc/g, and the obtained magnetic toner comprising positively chargeable hydrophobic dry silica and spherical polyvinylidene fluoride particles had a tribo-value of +11.5 μc/g.

The image formed had a density of 1.20 and significantly fogged. Under the environmental conditions of the temperature and humidity being respectively 15° C. and 10% RH, the toner aggregated on the developing sleeve, resulting in the occurrence of non-uniformity in the toner coating.

The image formed was slightly stained by offset. In addition, a scar of a white line having a length of 1 to 2 cm was sometime produced on the image formed by the fixing separating claw provided on the heated roll fixing unit.

Comparative Example 3

Magnetic toner particles were produced by the same method as that employed in Example 2 with the exception that no quaternary ammonium salt was used.

The obtained magnetic toner particles had a tribo-value of +9.0 μc/g, and the obtained magnetic toner comprising positively chargeable hydrophobic dry silica and spherical polyvinylidene fluoride particles had a tribo-value of +8.0 μc/g.

The image formed had a background significantly fogged and a density as low as about 1.10 which was 1.0 or less after images had been printed on 2,000 sheets. At this time, the image density was recovered to 1.10 by cleaning the developing sleeve with a solvent. This revealed that the decreased in the image density was caused by contamination of the developing sleeve. After images had been printed on 20,000 sheets, the fixing roll was stained with the toner, and the anti-offset properties deteriorated.

Comparative Example 4

Magnetic toner particles were produced by the same method as that employed in Example 1 with the exception that no nigrosine dye was added. of +7.0 μc/g, and the obtained magnetic toner comprising positively chargeable hydrophobic dry silica and spherical polyvinylidene fluoride particles had a tribo-value of +5.0 μc/g.

The image formed had a density of 1.0 or less and was fogged. Under the environmental conditions that the temperature and humidity were respectively 32.5° C. and 85% RH, the image density was as low as 0.6.

Comparative Example 5

Magnetic toner particles were produced by the same employed in Example 1 with the exception that no vinyl copolymer was used, and 100 parts of styrene/-butadiene/divinylbenzene copolymer was added.

The obtained magnetic toner particles had a tribo-value of +9.0 μc/g, and the obtained magnetic toner comprising positively chargeable hydrophobic dry silica and spherical polyvinylidene fluoride particles had a tribo-value of +8.5 μc/g.

The image formed had a density of 1.2 or less and a background significantly fogged. Under the environmental conditions that the temperature and humidity were respectively 23.5° C. and 60% RH, non-uniformity occurred in the toner coating on the developing sleeve.

Example 5

Magnetic toner particles were produced by the same method as that employed in Example 1 with the exception that the vinyl copolymer having an acid value and used in Example 1 was replaced by the copolymer below.

| | |
|---|---|
| Styrene/n-butyl acrylate/n-butyl maleate/ divinylbenzene copolymer (component ratio by weight = 70.0/21.5/8.0/0.4, acid value = 18, Mw = 300,000) | 60 parts |

The obtained magnetic toner particles had a tribo-value of +6.5 μc/g, and the obtained magnetic toner comprising positively chargeable hydrophobic dry silica and spherical polyvinylidene fluoride particles had a tribo-value of +5.0 μc/g.

As a result of printing on 100,000 sheets under the environmental conditions that the temperature and humidity were respectively 23.5° C. and 60% RH, 32.5° C. and 85% RH and 15° C. and 10% RH, the image formed constantly had a density of 1.25 or more and was not fogged. Neither offset to the image nor stain on the fixing roll was observed. In addition, the anti-winding properties were good.

Comparative Example 6

Magnetic toner particles were produced by the same method as that employed in Example 5 with the exception that the vinyl copolymer having an acid value and used in Example 5 was replaced by the copolymer below having an increased acid value.

| | |
|---|---|
| Styrene/n-butyl acrylate/n-butyl maleate/ divinylbenzene copolymer (copolymer ratio by weight = 69.0/20.0/10.5/0.4, acid value = 37, Mw = 280,000) | 60 parts |

The obtained magnetic toner particles had a tribo-value of +6.0 μc/g, and the obtained magnetic toner comprising positively chargeable hydrophobic dry silica and spherical polyvinylidene fluoride particles had a tribo-value of +4.0 μc/g.

The image formed had a density of as low as 1.0 and was fogged.

Comparative Example 7

Magnetic toner particles were produced by the same the content ratio of the quaternary ammonium salt to the nigrosine dye was changed to 2.0/2.5.

The obtained magnetic toner particles had a tribo-value of +9.0 μc/g, and the obtained magnetic toner comprising positively chargeable hydrophobic dry silica and spherical polyvinylidene fluoride particles had a tribo-value of +8.0 μc/g.

The image formed is slightly stained by offset.

Comparative Example 8

Magnetic toner particles were produced by the same method as that employed in Example 1 with the exception that the content ratio of the quaternary ammonium salt to the nigrosine dye was changed to 0.2/0.1.

The obtained magnetic toner particles had a tribo-value of +8.5 μc/g, and the obtained magnetic toner comprising positively chargeable hydrophobic dry silica and spherical polyvinylidene fluoride particles had a tribo-value of +6.0 μc/g.

The image density was 1.25 under the environmental conditions of the temperature and humidity being respectively 23.5° C. and 60% RH and 15° C. and 10% RH, while the image density was sometimes less than 1.20 under the environmental conditions of the temperature and humidity being respectively 32.5° C. and 85% RH. When an image was formed after the toner had been allowed to stand for one night under the environmental conditions of the temperature and humidity being respectively 32.5° C. and 85% RH, the image density was less than 1.00. As a result printing under the environmental conditions of the temperature and humidity being respectively 32.5° C. and 85% RH, the image formed was slightly stained by offset.

Comparative Example 9

Magnetic toner particles were produced by the same method as that employed in Example 1 with the exception that the vinyl copolymer having an acid value and the styrene/butadiene/divinylbenzene copolymer, both of which were used in Example 1, were replaced by the following copolymer:

| | |
|---|---|
| Styrene/n-butyl acrylate/divinylbenzene copolymer (component ratio by weight = 77.5/22.0/0.4, acid value = 0, Mw = 320,000) | 100 parts |

The obtained magnetic toner particles had a tribo-value of +9.5 μc/g, and the obtained magnetic toner comprising positively chargeable hydrophobic dry silica and spherical polyvinylidene fluoride particles had a tribo-value of +8.0 μc/g.

The density of the image formed was as low as 1.0 to 1.2 and sometimes 1.0 or less under the environmental conditions of the temperature and humidity being respectively 32.5° C. and 85% RH. Under the environmental conditions of the temperature and humidity being respectively 15° C. and 10% RH, the image had a density of 1.1 to 1.2 and a background remarkably fogged. When printing was carried out without supplying the toner, the density was decreased to about 0.6.

Comparative Example 10

Magnetic toner particles were produced by the same method as that employed in Comparative Example 9 with the exception that the amount of the nigrosine used in Comparative Example 9 was changed to 2.0 parts.

The obtained magnetic toner particles had a tribo-value of +10.5 μc/g, and the obtained magnetic toner comprising positively chargeable hydrophobic dry silica and spherical polyvinylidene fluoride particles had a tribo-value of +9.5 μc/g.

Although the density of the image formed was 1.2 or more, the developing sleeve was dyed blue by continuous printing. Although the density was not much decreased during printing, when printing was interrupted for one day or more, the image density was decreased by 0.1 or more, as compared with the density before interruption of printing. Under the environmental conditions of the temperature and humidity being respectively 32.5° C. and 85% RH, after printing had been interrupted, the image density is hardly recovered to the density obtained before interruption of printing, and the whole image formed was significantly fogged.

Comparative Example 11

Magnetic toner particles were produced by the same method as that employed in Example 1 with the exception that the vinyl copolymer having an acid value and used in Example 1 was replaced by the following copolymer:

| | |
|---|---|
| Styrene/n-butyl acrylate/n-butyl maleate/divinylbenzene copolymer (copolymer ratio by weight = 75/23.5/0.8/0.7, acid value = 2.5, Mw = 380,000) | 60 parts |

The obtained magnetic toner particles had a tribo-value of +8.5 μc/g, and the obtained magnetic toner comprising positively chargeable hydrophobic dry silica and spherical polyvinylidene fluoride particles had a tribo-value of +8.5 μc/g.

The initial density of the image formed was 130 or more, and the toner had good rising properties and performance. After the toner had been stored for a certain time, there was the tendency that fogging occurred to some extent and was increased under the environmental conditions of low humidity.

Although the image formed was slightly stained by offset to a substantially negligible extent, some scars were produced by the fixing separating claw.

While the present invention has been described with respect to what is presently considered to be the preferred embodiments, it is to be understood that the invention is not limited to the disclosed embodiment. On the contrary, the invention is intended to cover various modifications and equivalents included within the spirit and scope of the appended claims.

What is claimed is:

1. A positively chargeable magnetic toner comprising positively chargeable magnetic toner particles having at least a binder resin, a magnetic substance and a charge controlling agent; wherein said binder resin contains (A) a vinyl polymer or vinyl copolymer having polar functional groups selected from the group consisting of carboxyl groups, acid anhydride groups, partial esters of said carboxyl groups, partial esters of said acid anhydride groups or mixtures thereof and having an acid value of 5 to 30, and (B) a copolymer obtained by polymerizing at least a diolefin monomer and a vinyl monomer, and said charge controlling agent contains (C) a quaternary ammonium salt and (D) a nigrosine dye or a triphenylmethane dye, the ratio by weight among the components (A), (B), (C) and (D) being within the range of (A):(B):(C):(D)=80 to 30:70 to 20:2.0 to 0.5:2:0 to 0.1 relative to 100 parts of the total weight of said components (A) and (B).

2. The positively chargeable toner according to claim 1, wherein said component (A) comprises a homopolymer having a monomer selected from the group consisting of acrylic acid, methacrylic acid, maleic acid, itaconic acid, citraconic acid, dimethylmaleic acid and acid anhydrides and/or partial ester thereof or a copolymer having at least one of said monomers and at least one vinyl monomer.

3. The positively chargeable toner according to claim 2, wherein said component (A) comprises a styrene/n-butyl acrylate/n-butyl maleate/divinylbenzene copolymer.

4. The positively chargeable toner according to claim 2, wherein said component (A) comprises a styrene/2-ethylhexyl acrylate/n-butyl maleate/divinylbenzene copolymer.

5. The positively chargeable toner according to claim 1, wherein said component (B) comprises a diolefin monomer and a vinyl monomer.

6. The positively chargeable toner according to claim 5, wherein said component (B) comprises a styrene/-butadiene copolymer.

7. The positively chargeable toner according to claim 5, wherein said component (B) comprises a styrene/-butadiene/divinylbenzene copolymer.

8. The positively chargeable toner according to claim 1, wherein said component (C) comprises a quaternary ammonium salt having the following formula:

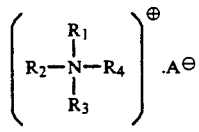

wherein $R_1$, $R_2$, $R_3$ and $R_4$ may be the same as or different from each other and are each an alkyl group having 1 to 30 carbon atoms, an aryl group which may have a substituent in its aromatic ring or an aralkyl group $-CH_2-_nAr$, wherein n =1 to 5 and Ar=an aryl group; and $A^-$ is an anion

9. The positively chargeable toner according to claim 8, wherein $A^-$ in said quaternary ammonium salt is an anion selected from the group consisting of halogen ions, sulfate ions, nitrate ions, borate ions, phosphate ions, organic sulfate ions, organic sulfonate ions, organic phosphate ions, polyacid ions, heteropolyacid ions, carboxylate ions and tetrafluoroborate ions.

10. The positively chargeable toner according to claim 9, wherein said quaternary ammonium salt is a compound having the following formula:

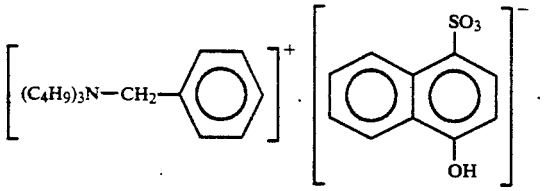

11. The positively chargeable toner according to claim 9, wherein said quaternary ammonium salt is a compound having the following formula:

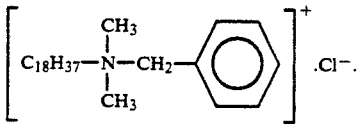

12. The positively chargeable toner according to claim 9, wherein said quaternary ammonium salt is a compound having the following formula:

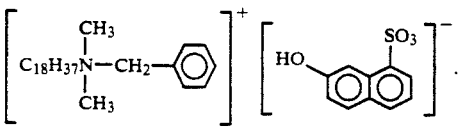

13. The positively chargeable toner according to claim 1, wherein said component (C) comprises a quaternary ammonium salt having the following formula:

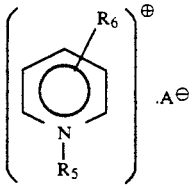

wherein $R_5$ is an alkyl group having 1 to 30 carbon atoms or an aralkyl group $—CH_2—_nAR$, wherein N=1 to 5 and Ar=aryl group, $R_6$ is analkyl group having 1 to 10 carbon atoms, and $A^-$ is an anion.

14. The positively chargeable toner according to claim 13, wherein said quaternary ammonium salt has at least one of said $R_6$ group.

15. The positively chargeable toner according to claim 13, wherein $A^-$ in said quaternary ammonium salt is an anion selected from the group consisting of halogen ions, sulfate ions, nitrate ions, borate ions, phosphate ions, organic sulfate ions, organic sulfonate ions, organic phosphate ions, polyacid ions, heteropolyacid ions, carboxylate ions and tetrafluoroborate ions.

16. The positively chargeable toner according to claim 1, wherein said component (D) comprises an oil-soluble or basic nitrogen-containing dye.

17. The positively chargeable toner according to claim 16, wherein said component (D) comprises a compound selected from the group consisting of nigrosine dyes, nigrosine dyes treated with fatty acids and nigrosine dyes treated with resin acids.

18. The positively chargeable toner according to claim 16, wherein said component (D) comprises a triphenylmethane dye having the following formula:

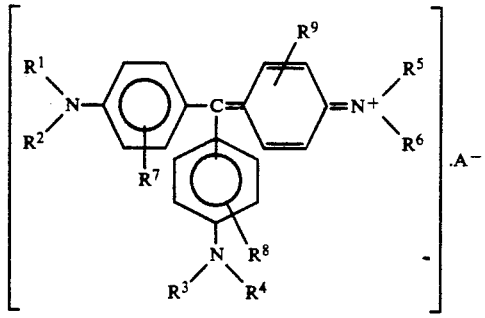

wherein $R^1$, $R^2$, $R^3$, $R^4$, $R^5$ and $R^6$ may be the same as or different from each other and are each a hydrogen atom, a substituted or unsubstituted alkyl group or a substituted or unsubstituted aryl group, $R^7$, $R^8$ and $R^9$ may be the same as or different from each other and are each a hydrogen atom a halogen tom, an alkyl group or an alkoxy group, $A^-$ is anion selected from the group consisting of sulfate ions, nitrate ions, borate ions, phosphate ions, hydroxyl ions, organic sulfate ions, organic sulfonate ions, organic phosphate ions, carboxylate ions, organic borate ions and tetrafluoroborate ions.

19. The positively chargeable toner according to claim 18, wherein said component (D) comprises a triphenylmethane dye having the following formula:

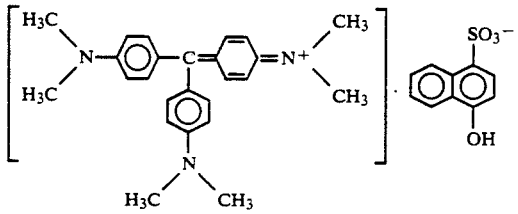

20. The positively chargeable toner according to claim 1, wherein said toner contains said magnetic substance in an amount of 20 to 150 parts by weight based on 100 parts by weight of the total weight of said components (A) and (B) contained in said binder resin.

21. The positively chargeable toner according to claim 1, wherein said toner comprises silica fine powder.

22. The positively chargeable toner according to claim 21, wherein said silica fine powder is contained in said positively chargeable magnetic toner in an amount of 0.01 to 8 parts by weight relative to 100 parts by weight of said positively chargeable magnetic toner particles.

23. The positively chargeable toner according to claim 21, wherein said silica fine powder is contained in said positively chargeable magnetic toner in an amount of 0.1 to 5 parts by weight relative to 100 parts by weight of said positively chargeable magnetic toner particles.

24. The positively chargeable toner according to claim 21, wherein said silica fine powder has a BET specific surface area of 30 $m^2/g$ or more.

25. The positively chargeable toner according to claim 21, wherein said silica fine powder has a BET specific surface area of 50 to 400 $m^2/g$.

26. The positively chargeable toner according to claim 21, wherein said silica fine powder has positive chargeability.

27. The positively chargeable toner according to claim 26, wherein said silica fine powder is produced by a dry method.

28. The positively chargeable toner according to claim 21, wherein said silica fine powder is a hydrophobic silica fine powder treated with an agent for making said silica fine powder hydrophobic.

29. The positively chargeable toner according to claim 1, wherein said toner further comprises fluorine-containing polymer fine powder.

30. The positively chargeable toner according to claim 29, wherein said fluorine-containing polymer fine powder is contained in an amount of 0.01 to 2.0 parts by weight relative to 100 parts by weight of said positively chargeable magnetic toner particles.

31. The positively chargeable toner according to claim 29, wherein said fluorine-containing polymer fine powder is contained in an amount of 0.02 to 1.0 parts by weight relative to 100 parts by weight of said positively chargeable magnetic toner particles.

32. The positively chargeable toner according to claim 29, wherein said fluorine-containing polymer fine powder is polyvinylidene fluoride fine powder.

33. The positively chargeable toner according to claim 1, wherein said toner further comprises a wax substance.

34. The positively chargeable toner according to claim 33, wherein said wax substance is contained in said positively chargeable magnetic toner particles.

35. The positively chargeable toner according to claim 34, wherein said wax substance contains low-molecular weight polyethylene.

36. The positively chargeable toner according to claim 34, wherein said wax substance contains a low-molecular weight propylene/ethylene copolymer.

37. The positively charageable toner according to claim 34, wherein 0.5 to 5% weight of said wax substance is contained in said positively chargeable magnetic toner particles.

38. An image forming process comprising:

transferring a positively chargeable magnetic toner positively charged by friction with a toner supporting member and supported on a surface thereof to an electrostatic image holding member holding an electrostatic image on a surface thereof in a developing section in which said electrostatic holding member and said toner supporting member are disposed at a predetermined distance;

developing said electrostatic image by said positively chargeable magnetic toner to form a developed image;

transferring the developed image to a recording material with the same polarity as that of said electrostatic image; and fixing an unfixed toner image on said recording material by applying heat and pressure thereto to form a fixed toner image;

wherein said said positively chargeable magnetic toner comprises positively chargeable magnetic toner particles having a binder resin, a magnetic substance and a charge controlling agent, wherein said binder resin contains (A) a vinyl polymer having polar functional groups selected from the group consisting of carboxyl groups, acid anhydride groups, partial esters of said carboxyl groups, partial esters of said acid anhydride groups or mixtures thereof and having an acid value of 5 to 30, and (B) a copolymer obtained by polymerizing at least a diolefin monomer and a vinyl monomer or vinyl copolymer, and wherein said charge controlling agent contains (C) a quaternary ammonium salt and (D) a nigrosine dye or a triphenylmethane dye, the ratio by weight among the components (A), (B), (C) and (D) being within the range of (A):(B):(C):(D)=80 to 30:70 to 20:2.0 to 0.5:2.0 to 0.1 relative to 100 parts of the total weight of said components (A) and (B).

39. The image forming process according to claim 38, wherein said said component (A) comprises a homopolymer having a monomer selected from the group consisting of acrylic acid, methacrylic acid, maleic acid, itaconic acid, citraconic acid, dimethylmaleic acid and acid anhydrides and partial esters thereof or a copolymer having at least one of said monomers and at least one vinyl monomer.

40. The image forming process according to claim 39, wherein said component (A) comprises a styrene/n-butyl acrylate/n-butyl maleate/divinylbenzene copolymer.

41. The image forming process according to claim 39, wherein said component (A) comprises a styrene/2-ethylhexyl acrylate/n-butyl maleate/divinylbenzene copolymer.

42. The image forming process according to claim 38, wherein said component (B) comprises a diolefin monomer and a vinyl monomer.

43. The image forming process according to claim 42, wherein said component (B) comprises a styrene/-butadiene copolymer.

44. The image forming process according to claim 42, wherein said component (B) comprises a styrene/-butadiene/divinylbenzene copolymer.

45. The image forming process according to claim 38, wherein said component (C) comprises a quaternary ammonium salt having the following formula:

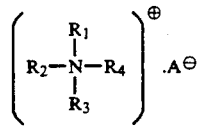

wherein $R_1$, $R_2$, $R_3$ and $R_4$ may be the same as or different from each other and are each an alkyl group having 1 to 30 carbon atoms, an aryl group which may have a substituent in its aromatic ring or an aralkyl group $-CH_2-_nAr$, wherein n =1 to 5 and AR=an aryl group; and $A^-$ is an anion.

46. The image forming process according to claim 45, wherein $A^-$ in said quaternary ammonium salt is an anion selected from the group consisting of halogen ions, sulfate ions, nitrate ions, borate ions, phosphate ions, organic sulfate ions, organic sulfonate ions, organic phosphate ions, polyacid ions, heteropolyacid ions, carboxylate ions and tetrafluoroborate ions.

47. The image forming process according to claim 46, wherein said quaternary ammonium salt is a compound having the following formula:

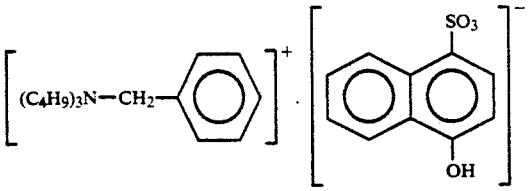

48. The image forming process according to claim 46, wherein said quaternary ammonium salt is a compound having the following formula:

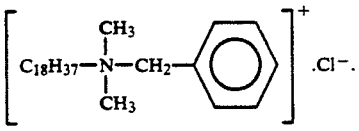

49. The image forming process according to claim 46, wherein said quaternary ammonium salt is a compound having the following formula:

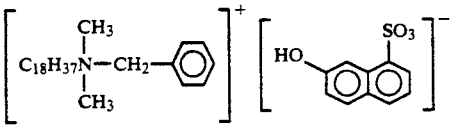

50. The image forming process according to claim 38, wherein said component (C) comprises a quaternary ammonium salt having the following formula:

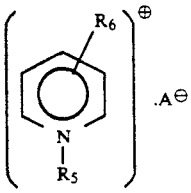

wherein $R_5$ is an alkyl group having 1 to 30 carbon atoms or an aralkyl group $-CH_2-_nAr$, wherein n=1 to 5 and Ar=aryl group, $R_6$ is an alkyl group having 1 to 10 carbon atoms, and $A^-$ is an anion.

51. The image forming process according to claim 50, wherein said quaternary ammonium salt has at least one of said $R_6$ group.

52. The image forming process according to claim 50, wherein $A^-$ in said quarternary ammonium salt is an anion selected from the group consisting of halogen ions, sulfate ions, nitrate ions, borate ions, phosphate ions, organic sulfate ions, organic sulfonate ions, organic phosphate ions, polyacid ions, heteropolyacid ions, carboxylate ions and tetrafluoroborate ions.

53. The image forming process according to claim 38, wherein said component (D) comprises an oil-soluble or basic nitrogen-containing dye.

54. The image forming process according to claim 53, wherein said component (D) comprises a compound selected from the group consisting of nigrosine dyes, nigrosine dyes treated with fatty acids and nigrosine dyes treated with resin acids.

55. The image forming process according to claim 53, wherein said component (D) comprises a triphenylmethane dye having the following formula:

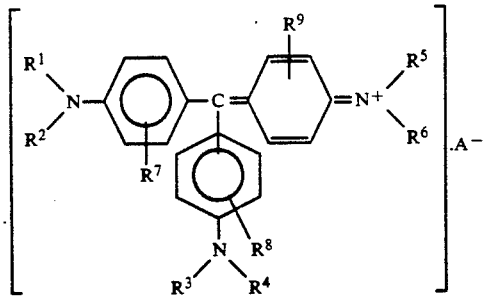

wherein $R^1$, $R^2$, $R^3$, $R^4$, $R^5$ and $R^6$ may be the same as or different from each other and are each a hydrogen atom, a substituted or unsubstituted alkyl group or a substituted or unsubstituted aryl group, $R^7$, $R^8$ and $R^9$ may be the same as or different from each other and are each a hydrogen atom a halogen atom, an alkyl group or an alkoxy group, $A^-$ is anion selected from the group consisting of sulfate ions, nitrate ions, borate ions, phosphate ions, hydroxyl ions, organic sulfate ions, organic sulfonate ions, organic phosphate ions, carboxylate ions, organic borate ions and tetrafluoroborate ions.

56. The image forming process according to claim 55, wherein said component (D) comprises a triphenylmethane dye having the following formula:

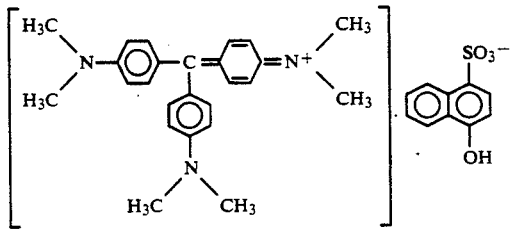

57. The image forming process according to claim 38, wherein said toner contains said magnetic substance in an amount of 20 to 150 parts by weight based on 100 parts by weight of the total weight of said components (A) and (B) contained in said binder resin.

58. The image forming process according to claim 38, wherein said toner comprises silica fine powder.

59. The image forming process according to claim 58, wherein said silica fine powder is contained in said positively chargeable magnetic toner in an amount of 0.01 to 8 parts by weight relative to 100 parts by weight of said positively chargeable magnetic toner particles.

60. The image forming process according to claim 58, wherein said silica fine powder is contained in said positively chargeable magnetic toner in an amount of 0.1 to 5 parts by weight relative to 100 parts by weight of said positively chargeable magnetic toner particles.

61. The image forming process according to claim 58, wherein said silica fine powder has a BET specific surface area of 30 $m^2/g$ or more.

62. The image forming process according to claim 58, wherein said silica fine powder has a BET specific surface area of 50 to 400 $m^2/g$.

63. The image forming process according to claim 58, wherein said silica fine powder has positive chargeability.

64. The image forming process according to claim 62, wherein said silica fine powder is produced by a dry method.

65. The image forming process according to claim 58, wherein said silica fine powder is a hydrophobic silica fine powder treated with an agent for making said silica fine powder hydrophobic.

66. The image forming process according to claim 38, wherein said toner further comprises fluorine-containing polymer fine powder.

67. The image forming process according to claim 66, wherein said fluorine-containing polymer fine powder is contained in an amount of 0.01 to 2.0 parts by weight relative to 100 parts by weight of said positively chargeable magnetic toner particles.

68. The image forming process according to claim 66, wherein said fluorine-containing polymer fine powder is contained in an amount of 0.02 to 1.0 parts by weight relative to 100 parts by weight of said positively chargeable magnetic toner particles.

69. The image forming process according to claim 66, wherein said fluorine-containing polymer fine powder is polyvinylidene fluoride fine powder.

70. The image forming process according to claim 38, wherein said toner further comprises a wax substance.

71. The image forming process according to claim 70, wherein said wax substance is contained in said positively chargeable magnetic toner particles.

72. The image forming process according to claim 71, wherein said wax substance contains low-molecular weight polyethylene.

73. The image forming process according to claim 71, wherein said wax substance contains a low-molecular weight propylene/ethylene copolymer.

74. The image forming process according to claim 71, wherein 0.5 to 5% by weight of said wax substance is contained in said positively chargeable magnetic toner particles.

75. An image forming apparatus comprising:

an electrostatic image holding member for holding an electrostatic image;

charge means for charging said electrostatic image holding member;

developing means for developing said electrostatic image held by said electrostatic image holding member;

transfer means for transferring the image developed by said developing means to a recording material from said electrostatic image holding member; and fixing means for fixing the unfixed toner image transferred to said recording material to said recording material by applying heat and pressure thereto;

wherein said developing means comprises a positively chargeable magnetic toner comprising positively chargeable magnetic toner particles having at least a binder resin, a magnetic substance and a charge controlling agent and a toner holding member for positively charging said positively chargeable magnetic toner by friction therewith;

wherein said binder resin contains (A) a vinyl polymer or vinyl copolymer having polar functional groups selected from the group consisting of carboxyl groups, acid anhydride groups, partial esters of said carboxyl groups, partial esters of said acid anhydride groups or mixtures thereof and having an acid value of 5 to 30, and (B) a copolymer obtained by copolymerizing at least a diolefin monomer and a vinyl monomer; and wherein said charge controlling agent contains (C) a quaternary ammonium salt and (D) a nigrosine dye or a triphenylmethane dye, the ratio by weight among said components (A), (B), (C) and (D) being within the range of (A):(B):(C):(D)=80 to 30:70 to 20:2.0 to 0.5: 2.0 to 0.1 relative to 100 parts of the total weight of said components (A) and (B).

76. The image forming apparatus according to claim 75, wherein said component (A) comprises a homopolymer having a monomer selected from the group consisting of acrylic acid, methacrylic acid, maleic acid, itaconic acid, citraconic acid, dimethylmaleic acid and acid anhydrides and/or partial ester thereof or a copolymer having at least one of said monomers and at least one vinyl monomer.

77. The image forming apparatus according to claim 76, wherein said component (A) comprises a styrene/n-butyl acrylate/n-butyl maleate/divinylbenzene copolymer.

78. The image forming apparatus according to claim 76, wherein said component (A) comprises a styrene/2-ethylhexyl acrylate/n-butyl maleate/divinylbenzene copolymer.

79. The image forming apparatus according to claim 75, wherein said component (B) comprises a diolefin monomer and a vinyl monomer.

80. The image forming apparatus according to claim 79, wherein said component (B) comprises a styrene/-butadiene copolymer.

81. The image forming apparatus according to claim 79, wherein said component (B) comprises a styrene/-butadiene/divinylbenzene copolymer.

82. The image forming apparatus according to claim 75, wherein said component (C) comprises a quaternary ammonium salt having the following formula:

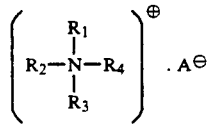

wherein $R_1$, $R_2$, $R_3$ and $R_4$ may be the same as or different from each other and are each an alkyl group having 1 to 30 carbon atoms, an aryl group which may have a substituent in its aromatic ring or an aralkyl group $-CH_2-_nAr$, wherein n =1 to 5 and Ar=an aryl group; and $A^-$ is an anion.

83. The image forming apparatus according to claim 82, wherein $A^-$ in said quaternary ammonium salt is an anion selected from the group consisting of halogen ions, sulfate ions, nitrate ions, borate ions, phosphate ions, organic sulfate ions, organic sulfonate ions, organic phosphate ions, polyacid ions, heteropolyacid ions, carboxylate ions and tetrafluoroborate ions.

84. The image forming apparatus according to claim 83, wherein said quaternary ammonium salt is a compound having the following formula:

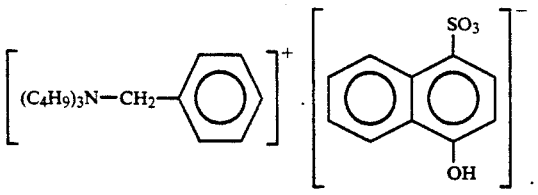

85. The image forming apparatus according to claim 83, wherein said quaternary ammonium salt is a compound having the following formula:

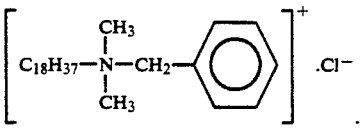

86. The image forming apparatus according to claim 83, wherein said quaternary ammonium salt is a compound having the following formula:

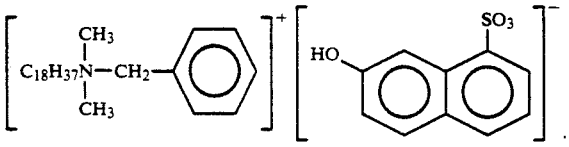

87. The image forming apparatus according to claim 75, wherein said component (C) comprises a quaternary ammonium salt having the following formula:

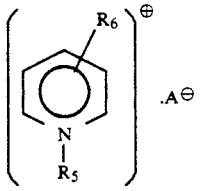

wherein $R_5$ is an alkyl group having 1 to 30 carbon atoms or an aralkyl group $—CH_2—_nAr$, wherein n=1 to 5 and Ar=aryl group, $R_6$ is an alkyl group having 1 to 10 carbon atoms, and $A^-$ is an anion.

88. The image forming apparatus according to claim 87, wherein said quaternary ammonium salt has at least one of said $R_6$ group.

89. The image forming apparatus according to claim 87, wherein $A^-$ in said quaternary ammonium salt is an anion selected from the group consisting of halogen ions, sulfate ions, nitrate ions, borate ions, phosphate ions, organic sulfate ions, organic sulfonate ions, organic phosphate ions, polyacid ions, heteropolyacid ions, carboxylate ions and tetrafluoroborate ions.

90. The image forming apparatus according to claim 76, wherein said component (D) comprises an oil-soluble or basic nitrogen-containing dye.

91. The image forming apparatus according to claim 90, wherein said component (D) comprises a compound selected from the group consisting of nigrosine dyes, nigrosine dyes treated with fatty acids and nigrosine dyes treated with resin acids.

92. The image forming apparatus according to claim 90, wherein said component (D) comprises a triphenylmethane dye having the following formula:

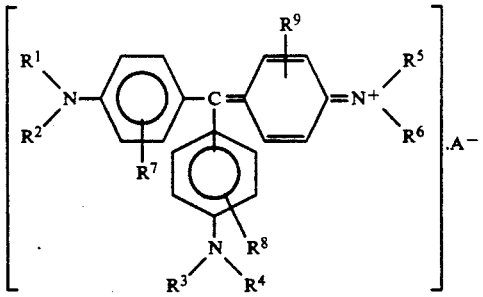

wherein $R^1$, $R^2$, $R^3$, $R^4$, $R^5$ and $R^6$ may be the same as or different from each other and are each a hydrogen atom, a substituted or unsubstituted or unsubstituted alkyl group or a substituted or unsubstituted aryl group, $R^7$, $R^8$ and $R^9$ may be the same as or different from each other and are each a hydrogen atom a halogen atom, an alkyl group or an alkoxy group, $A^-$ is anion selected from the group consisting of sulfate ions, nitrate ions, borate ions, phosphate ions, hydroxyl ions, organic sulfate ions, organic sulfonate ions, organic phosphate ions, carboxylate ions, organic borate ions and tetrafluoroboate ions.

93. The image forming apparatus according to claim 92, wherein said component (D) comprises a triphenylmethane dye having the following formula:

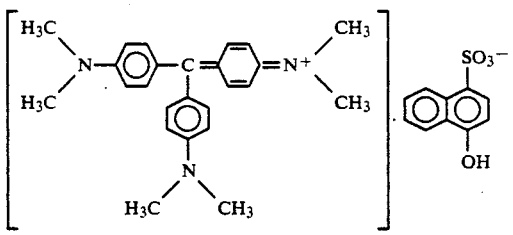

94. The image forming apparatus according to claim 75, wherein said toner contains said magnetic substance in an amount of 20 to 150 parts by weight based on 100 parts by weight of the total weight of said components (A) and (B) contained in said binder resin.

95. The image forming apparatus according to claim 75, wherein said toner comprises silica fine powder.

96. The image forming apparatus according to claim 95, wherein said silica fine powder is contained in said positively chargeable magnetic toner in an amount of 0.01 to 8 parts by weight relative to 100 parts by weight of said positively chargeable magnetic toner particles.

97. The image forming apparatus according to claim 95, wherein said silica fine powder is contained in said positively chargeable magnetic toner in an amount of 0.1 to 5 parts by weight relative to 100 parts by weight of said positively chargeable magnetic toner particles.

98. The image forming apparatus according to claim 95, wherein said silica fine powder has a BET specific surface area of 30 $m^2/g$ or more.

99. The image forming apparatus according to claim 95, wherein said silica fine powder has a BET specific surface area of 50 to 400 $m^2/g$.

100. The image forming apparatus according to claim 95, wherein said silica fine powder has positive chargeability.

101. The image forming apparatus according to claim 100, wherein said silica fine powder is produced by a dry method.

102. The image forming apparatus according to claim 95, wherein said silica fine powder is a hydrophobic silica fine powder treated with an agent for making said silica fine powder hydrophobic.

103. The image forming apparatus according to claim 75, wherein said toner further comprises fluorine-containing polymer fine powder.

104. The image forming apparatus according to claim 103, wherein said fluorine-containing polymer fine powder is contained in an amount of 0.01 to 2.0 parts by weight relative to 100 parts by weight of said positively chargeable magnetic toner particles.

105. The image forming apparatus according to claim 103, wherein said fluorine-containing polymer fine powder is contained in an amount of 0.02 to 1.0 parts by weight relative to 100 parts by weight of said positively chargeable magnetic toner particles.

106. The image forming apparatus according to claim 103, wherein said fluorine-containing polymer fine powder is polyvinylidene fluoride fine powder.

107. The image forming apparatus according to claim 75, wherein said toner further comprises a wax substance.

108. The image forming apparatus according to claim 107, wherein said wax substance is contained in said positively chargeable magnetic toner particles.

109. The image forming apparatus according to claim 108, wherein said wax substance contains low-molecular weight polyethylene.

110. The image forming apparatus according to claim 108, wherein said wax substance contains a low-molecular weight propylene/ethylene copolymer.

111. The image forming apparatus according to claim 108, wherein 0.5 to 5% by weight of said wax substance is contained in said positively chargeable magnetic toner particles.

112. An apparatus unit comprising:

an electrostatic image holding member for holding an electrostatic image:

charge means for charging said electrostatic image holding member; and developing means supported integrally with at least one of said electrostatic image holding means and said charge means for developing the electrostatic image held by said electrostatic image holding member;

said apparatus unit being detachably mounted to an apparatus main body comprising transfer means for transferring the image developed by said developing means and fixing means for fixing to said recording material the unfixed toner image transferred to the recording material by applying head and pressure thereto;

wherein said developing means comprises a positively chargeable magnetic toner comprising positively chargeable magnetic toner particles having at least a binder resin, a magnetic substance and a charge controlling agent and a toner holding member for positively charging said positively chargeable magnetic toner by friction therewith;

wherein said binder resin contains (A) a vinyl polymer having polar functional groups selected from the group consisting of carboxyl groups, acid anhydride groups, partial esters of said carboxyl groups, partial esters of said acid anhydride groups or mixtures of thereof and having an acid value of 5 to 30, and (B) a copolymer obtained by polymerizing at least a diolefin monomer and a vinyl monomer; and wherein said charge controlling agent contains (C) a quaternary ammonium salt and (D) a nigrosine dye or a triphenylmethane, the ratio by weight among said components (A), (B), (C) and (D) being within the range of (A):(B): (C):(D)=80 to 30:70 to 20:2.0 to 0.5:2.0 to 0.1 relative to 100 parts of the total weight of said components (A) and (B).

113. The apparatus unit according to claim 112, wherein said component (A) comprises a homopolymer having a monomer selected from the group consisting of acrylic acid, methacrylic acid, maleic acid, itaconic acid, citraconic acid, dimethylmaleic acid and acid anhydrides and/or partial ester thereof or a copolymer having at least one of said monomers and at least one vinyl monomer.

114. The apparatus unit according to claim 113, wherein said component (A) comprises a styrene/n-butyl acrylate/n-butyl maleate/divinylbenzene copolymer.

115. The apparatus unit according to claim 113, wherein said component (A) comprises a styrene/2-ethylhexyl acrylate/n-butyl maleate/divinylbenzene copolymer.

116. The apparatus unit according to claim 112, wherein said component (B) comprises a diolefin monomer and a vinyl monomer.

117. The apparatus unit according to claim 116, wherein said component (B) comprises a styrene/-butadiene copolymer.

118. The apparatus unit according to claim 116, wherein said component (B) comprises a styrene/-butadiene/divinylbenzene copolymer.

119. The apparatus unit according to claim 112, wherein said component (C) comprises a quaternary ammonium salt having the following formula:

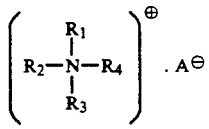

wherein $R_1$, $R_2$, $R_3$ and $R_4$ may be the same as or different from each other and are each an alkyl group having 1 to 30 carbon atoms, an aryl group which may have a substituent in its aromatic ring or an aralkyl group $-CH_2-_nAr$, wherein n =1 to 5 and Ar=an aryl group; and $A^-$ is an anion.

120. The apparatus unit according to claim 119, wherein $A^-$ in said quaternary ammonium salt is an anion selected from the group consisting of halogen ions, sulfate ions, nitrate ions, borate ions, phosphate ions, organic sulfate ions, organic sulfonate ions, organic phosphate ions, polyacid ions, heteropolyacid ions, carboxylate ions and tetrafluoroborate ions.

121. The apparatus unit according to claim 120, wherein said quaternary ammonium salt is a compound having the following formula:

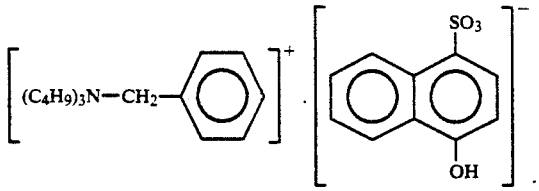

122. The apparatus unit according to claim 120, wherein said quaternary ammonium salt is a compound having the following formula:

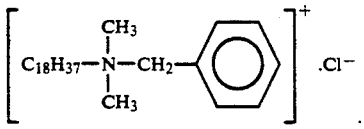

123. The apparatus unit according to claim 120, wherein said quaternary ammonium salt is a compound having the following formula:

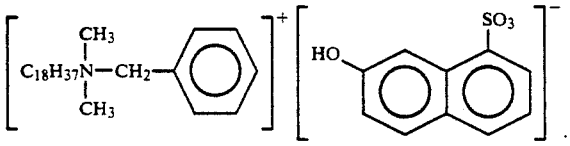

124. The apparatus unit according to claim 112, wherein said component (C) comprises a quaternary ammonium salt having the following formula:

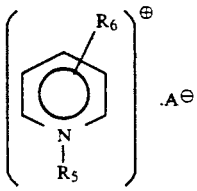

wherein $R_5$ is an alkyl group having 1 to 30 carbon atoms or an aralkyl group $-CH_2-_nAr$, wherein n=1 to 5 Ar=aryl group, $R_6$ is an alkyl group having 1 to 10 carbon atoms, and $A^-$ is an anion.

125. The apparatus unit according to claim 124, wherein said quaternary ammonium salt has at least one of said $R_6$ group.

126. The apparatus unit according to claim 124, wherein $A^-$ in said quaternary ammonium salt is an anion selected from the group consisting of halogen ions, sulfate ions, nitrate ions, borate ions, phosphate ions, organic sulfate ions, organic sulfonate ions, organic phosphate ions, polyacid ions, heteropolyacid ions, carboxylate ions and tetrafluoroborate ions.

127. The apparatus unit according to claim 112, wherein said component (D) comprises an oil-soluble or basic nitrogen-containing dye.

128. The apparatus unit according to claim 127, wherein said component (D) comprises a compound selected from the group consisting of nigrosine dyes, nigrosine dyes treated with fatty acids and nigrosine dyes treated with resin acids.

129. The apparatus unit according to claim 127, wherein said component (D) comprises a triphenylmethane dye having the following formula:

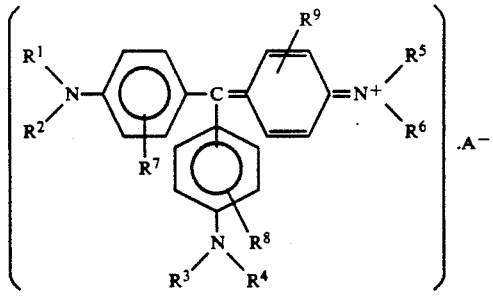

wherein $R^1$, $R^2$, $R^3$, $R^4$, $R^5$ and $R^6$ may be the same as or different from each other and are each a hydrogen atom, a substituted or unsubstituted alkyl group or a substituted or unsubstituted aryl group, $R^7$, $R^8$ and $R^9$ may be the same as or different from each other and are each a hydrogen atom a halogen atom, an alkyl group or an alkoxy group, $A^-$ is anion selected from the group consisting of sulfate ions, nitrate ions, borate ions, phosphate ions, hydroxyl ions, organic sulfate ions, organic sulfonate ions, organic phosphate ions, carboxylate ions, organic borate ions and tetrafluoroborate ions.

130. The apparatus unit according to claim 129, wherein said component (D) comprises a triphenylmethane dye having the following formula:

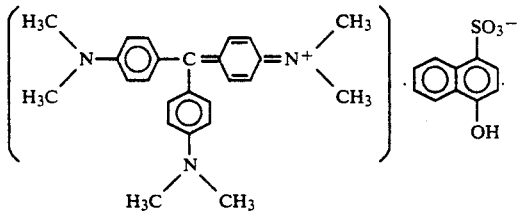

131. The apparatus unit according to claim 112, wherein said toner contains said magnetic substance in an amount of 20 to 150 parts by weight based on 100 parts by weight of the total weight of said components (A) and (B) contained in said binder resin.

132. The apparatus unit according to claim 112, wherein said toner comprises silica fine powder.

133. The apparatus unit according to claim 132, wherein said silica fine powder is contained in said positively chargeable magnetic toner in an amount of 0.01 to 8 parts by weight relative to 100 parts by weight of said positively chargeable magnetic toner particles.

134. The apparatus unit according to claim 132, wherein said silica fine powder is contained in said positively chargeable magnetic toner in an amount of 0.1 to 5 parts by weight relative to 100 parts by weight of said positively chargeable magnetic toner particles.

135. The apparatus unit according to claim 132, wherein said silica fine powder has a BET specific surface area of 30 $m^2/g$ or more.

136. The apparatus unit according to claim 132, wherein said silica fine powder has a BET specific surface area of 50 to 400 $m^2/g$.

137. The apparatus unit according to claim 132, wherein said silica fine powder has positive chargeability.

138. The apparatus unit according to claim 137, wherein said silica fine powder is produced by a dry method.

139. The apparatus unit according to claim 132, wherein said silica fine powder is a hydrophobic silica fine powder treated with an agent for making said silica fine powder hydrophobic.

140. The apparatus unit according to claim 112, wherein said toner further comprises fluorine-containing polymer fine powder.

141. The apparatus unit according to claim 140, wherein said fluorine-containing polymer fine powder is contained in an amount of 0.01 to 2.0 parts by weight relative to 100 parts by weight of said positively chargeable magnetic toner particles.

142. The apparatus unit according to claim 140, wherein said fluorine-containing polymer fine powder is contained in an amount of 0.02 to 1.0 parts by weight relative to 100 parts by weight of said positively chargeable magnetic toner particles.

143. The apparatus unit according to claim 140, wherein said fluorine-containing polymer fine powder is polyvinylidene fluoride fine powder.

144. The apparatus unit according to claim 112, wherein said toner further comprises a wax substance.

145. The apparatus unit according to claim 144, wherein said wax substance is contained in said positively chargeable magnetic toner particles.

146. The apparatus unit according to claim 145, wherein said wax substance contains low-molecular weight polyethylene.

147. The apparatus unit according to claim 145, wherein said wax substance contains a low-molecular weight propylene/ethylene copolymer.

148. The apparatus unit according to claim 145, wherein 0.5 to 5% by weight of said wax substance is contained in said positively chargeable magnetic toner particles.

149. A facsimile apparatus comprising:

an electrophotographic unit comprising an electrostatic image holding means for holding an electrostatic image, charge means for charging said electrostatic image holding member, developing means for developing said electrostatic image held by said electrostatic image holding member, transfer means for transferring the image developed by said developing means to a recording material from said electrostatic image holding member, and fixing means for fixing to said recording material an unfixed toner image transferred thereto by applying and pressure; and receiving means for receiving image information from a remote terminal;

wherein said developing means comprises a positively chargeable magnetic toner comprising positively chargeable magnetic toner particles having at least a binder resin, a magnetic substance and a charge controlling agent and a toner holding member for positively charging said positively chargeable magnetic toner by friction therewith;

wherein said binder resin contains (A) a vinyl polymer or vinyl copolymer having polar functional groups selected from the group consisting of carboxyl groups, acid anhydride groups, partial esters of said carboxyl groups, partial esters of said acid anhydride groups or mixtures of thereof and having an acid value of 5 to 30, and (B) a copolymer obtained by polymerizing at least a diolefin monomer and a vinyl monomer; and wherein said charge controlling agent contains (C) a quaternary ammonium salt and (D) a nigrosine dye or a triphenylmetane, the ratio by weight among said components (A), (B), (C) and (D) being within the range of (A):(B): (C):(D)=80 to 30:70 to 20:2.0 to 0.5:2.0 to 0.1 (A) and (B).

150. The facsimile apparatus according to claim 149, wherein said component (A) comprises a homopolymer having a monomer selected from the group consisting of acrylic acid, methacrylic acid, maleic acid, itaconic acid, citraconic acid, dimethylmaleic acid and acid anhydrides and/or partial ester thereof or a copolymer having at least one of said monomers and at least one vinyl monomer.

151. The facsimile apparatus according to claim 150, wherein said component (A) comprises a styrene/n-butyl acrylate/n-butyl maleate/divinylbenzene copolymer.

152. The facsimile apparatus according to claim 150, wherein said component (A) comprises a styrene/2-ethylhexyl acrylate/n-butyl maleate/divinylbenzene copolymer.

153. The facsimile apparatus according to claim 149, wherein said component (B) comprises a diolefin monomer and a vinyl monomer.

154. The facsimile apparatus according to claim 153, wherein said component (B) comprises a styrene/-butadiene copolymer.

155. The facsimile apparatus according to claim 153, wherein said component (B) comprises a styrene/-butadiene/divinylbenzene copolymer.

156. The facsimile apparatus according to claim 149, wherein said component (C) comprises a quaternary ammonium salt having the following formula:

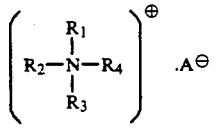

wherein $R_1$, $R_2$, $R_3$ and $R_4$ may be the same as or different from each other and are each an alkyl group having 1 to 30 carbon atoms, an aryl group which may have a substituent in its aromatic ring or an aralkyl group $-CH_2-_nAr$, wherein n =1 to 5 and Ar=an aryl group; and $A^-$ is an anion.

157. The facsimile apparatus according to claim 156, wherein $A^-$ in said quaternary ammonium salt is an anion selected from the group consisting of halogen ions, sulfate ions, nitrate ions, borate ions, phosphate ions, organic sulfate ions, organic sulfonate ions, organic phosphate ions, polyacid ions, heteropolyacid ions, carboxylate ions and tetrafluoroborate ions.

158. The facsimile apparatus according to claim 157, wherein said quaternary ammonium salt is a compound having the following formula:

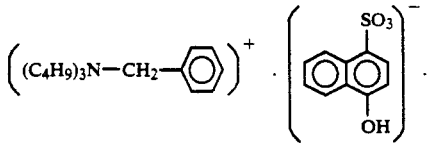

159. The facsimile apparatus according to claim 157, wherein said quaternary ammonium salt is a compound having the following formula:

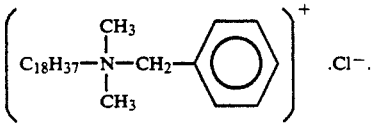

160. The facsimile apparatus according to claim 157, wherein said quaternary ammonium salt is a compound having the following formula:

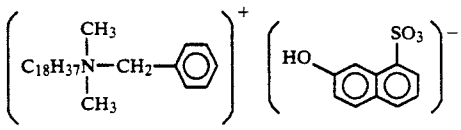

161. The facsimile apparatus according to claim 159, wherein said component (C) comprises a quaternary ammonium salt having the following formula:

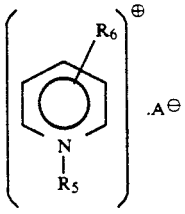

wherein $R_5$ is an alkyl group having 1 to 30 carbon atoms or an aralkyl group $-CH_2-_nAr$, wherein n=1 to 5 and Ar=aryl group, $R_6$ is an alkyl group having 1 to 10 carbon atoms, and $A^-$ is an anion.

162. The facsimile apparatus according to claim 161, wherein said quaternary ammonium salt has at least one of said $R_6$ group.

163. The facsimile apparatus according to claim 161, wherein $A^-$ in said quaternary ammonium salt is an anion selected from the group consisting of halogen ions, sulfate ions, nitrate ions, borate ions, phosphate ions, organic sulfate ions, organic sulfonate ions, organic phosphate ions, polyacid ions, heteropolyacid ions, carboxylate ions and tetrafluoroborate ions.

164. The facsimile apparatus according to claim 149, wherein said component (D) comprises an oil-soluble or basic nitrogen-containing dye.

165. The facsimile apparatus according to claim 164, wherein said component (D) comprises a compound selected from the group consisting of nigrosine dyes, nigrosine dyes treated with fatty acids and nigrosine dyes treated with resin acids.

166. The facsimile apparatus according to claim 164, wherein said component (D) comprises a triphenylmethane dye having the following formula:

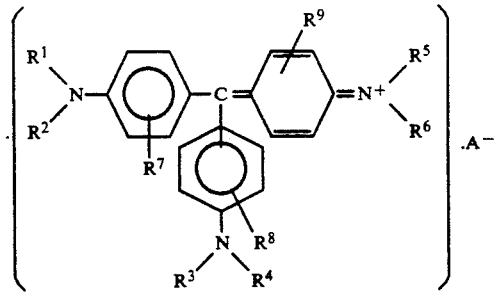

wherein $R^1$, $R^2$, $R^3$, $R^4$, $R^5$ and $R^6$ may be the same as or different from each other and are each a hydrogen atom, a substituted or unsubstituted alkyl group or a substituted or unsubstituted aryl group, $R^7$, $R^8$ and $R^9$ may be the same as or different from each other and are each a hydrogen atom a halogen atom, an alkyl group or an alkoxy group, $A^-$ is anion selected from the group consisting of sulfate ions, nitrate ions, borate ions, phosphate ions, hydroxyl ions, organic sulfate ions, organic sulfonate ions, organic phosphate ions carboxylate ions, organic borate ions and tetrafluoroborate ions.

167. The facsimile apparatus according to claim 166, wherein said component (D) comprises a triphenylmethane dye having the following formula:

168. The facsimile apparatus according to claim 149, wherein said toner contains said magnetic substance in an amount of 20 to 150 parts by weight based on 100 parts by weight of the total weight of said components (A) and (B) contained in said binder resin.

169. The facsimile apparatus according to claim 149, wherein said toner comprises silica fine powder.

170. The facsimile apparatus according to claim 169, wherein said silica fine powder is contained in said positively chargeable magnetic toner in an amount of 0.01 to 8 parts by weight relative to 100 parts by weight of said positively chargeable magnetic toner particles.

171. The facsimile apparatus according to claim 169, wherein said silica fine powder is contained in said positively chargeable magnetic toner in an amount of 0.1 to 5 parts by weight relative to 100 parts by weight of said positively chargeable magnetic toner particles.

172. The facsimile apparatus according to claim 169, wherein said silica fine powder has a BET specific surface area of 30 $m^2/g$ or more.

173. The facsimile apparatus according to claim 169, wherein said silica fine powder has a BET specific surface area of 50 to 400 $m^2/g$.

174. The facsimile apparatus according to claim 169, wherein said silica fine powder has positive chargeability.

175. The facsimile apparatus according to claim 174, wherein said silica fine powder is produced by a dry method.

176. The facsimile apparatus according to claim 169, wherein said silica fine powder is a hydrophobic silica fine powder treated with an agent for making said silica fine powder hydrophobic.

177. The facsimile apparatus according to claim 149, wherein said toner further comprises fluorine-containing polymer fine powder.

178. The facsimile apparatus according to claim 177, wherein said fluorine-containing polymer fine powder is contained in an amount of 0.01 to 2.0 parts by weight relative to 100 parts by weight of said positively chargeable magnetic toner particles.

179. The facsimile apparatus according to claim 177, wherein said fluorine-containing polymer fine powder is contained in an amount of 0.02 to 1.0 parts by weight relative to 100 parts by weight of said positively chargeable magnetic toner particles.

180. The facsimile apparatus according to claim 177, wherein said fluorine-containing polymer fine powder is polyvinylidene fluoride fine powder.

181. The facsimile apparatus according to claim 149, wherein said toner further comprises a wax substance.

182. The facsimile apparatus according to claim 181, wherein said wax substance is contained in said positively chargeable magnetic toner particles.

183. The facsimile apparatus according to claim 182, wherein said wax substance contains low-molecular weight polyethylene.

184. The facsimile apparatus according to claim 182, wherein said wax substance contains a low-molecular weight propylene/ethylene copolymer.

185. The facsimile apparatus according to claim 182, wherein 0.5 to 5% by weight of said wax substance is contained in said positively chargeable magnetic toner particles.

* * * * *

UNITED STATES PATENT AND TRADEMARK OFFICE

CERTIFICATE OF CORRECTION

PATENT NO. : 5,213,933

DATED : May 25, 1993

INVENTOR(S) : ICHIROU OSAKI, ET AL.

It is certified that error appears in the above-identified patent and that said Letters Patent is hereby corrected as shown below:

COLUMN 1

Line 3, "PROCESS" should read --PROCESS,--.

COLUMN 2

Line 45, "with" should be deleted.

COLUMN 3

Line 19, "polypropl-" should read --polypropylene--.
Line 20, "yene" should be deleted.

COLUMN 5

Line 32, "IT" should read --It--.
Line 35, "tone" should read --toner--.
Line 37, "hodling" should read --holding--.
Line 45, "taic" should read --tatic--.
Line 46, "recroding" should read --recording--.
Line 48, "positiely" should read --positively--.
Line 65, "invnetion" should read --invention--.
Line 68, "charing" should read --charging--.

COLUMN 6

Line 5, "form" should read --from--.
Line 9, "teh" should read --the--.
Line 11, "leat" should read --least--.
Line 17, "carboxy" should read --carboxyl--.

UNITED STATES PATENT AND TRADEMARK OFFICE

CERTIFICATE OF CORRECTION

PATENT NO. : 5,213,933

DATED : May 25, 1993

INVENTOR(S) : ICHIROU OSAKI, ET AL.

It is certified that error appears in the above-identified patent and that said Letters Patent is hereby corrected as shown below:

COLUMN 8

Line 7, "has" should read --have--.
Line 63, "P-" should read --p- --.

COLUMN 9

Line 1, "butyl-methacrylate," should be deleted.

COLUMN 11

Line 53, "of" (second occurrence) should read --or--.
Line 56, "postiively" should read --positively--.
Line 61, "an" should read --a--.

COLUMN 12

Line 24, "anion" should read --an anion--.
Line 25, "a" (fourth occurrence) should be deleted.
Line 26, "an" should be deleted.
Line 31 "triphenylemthane" should read --triphenylmethane--.

COLUMN 13

Line 42, "power," should read --powder,--.
Line 43, "tone" should read --toner--.
Line 47, "charageability." should read --chargeability.--.
Line 50, "charageability" should read --chargeability--.
Line 63, "$SiCl_4+2H_2+O_2 \rightarrow 2SiO_2+4HCl$" should read --$SiCl_4+2H_2+O_2 \rightarrow SiO_2+4HCl$--.
Line 68, "power" should read --powder--.

--

UNITED STATES PATENT AND TRADEMARK OFFICE

CERTIFICATE OF CORRECTION

PATENT NO. : 5,213,933

DATED : May 25, 1993

INVENTOR(S) : ICHIROU OSAKI, ET AL.

It is certified that error appears in the above-identified patent and that said Letters Patent is hereby corrected as shown below:

COLUMN 14

Line 11, "$Na_2O \cdot XSiO_2 + 2HCl + H_2O \rightarrow SiO_2 \cdot nH_2O + NaCl$" should read --$Na_2O \cdot XSiO_2 + 2HCl + H_2O \rightarrow SiO_2 \cdot nH_2O + 2NaCl$--.
Line 30, "power" should read --powder--.
Line 55, "in" should read --at--.
Line 56, "at" should read --in--.

COLUMN 15

Line 55, " 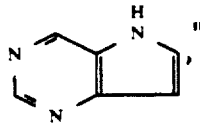 " should read -- 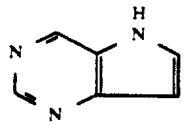 --.

Line 65, " 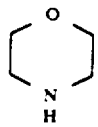 " should read -- 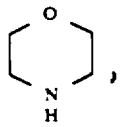 --.

COLUMN 16

Line 5, " 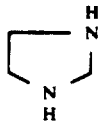 " should read -- 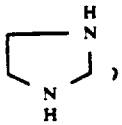 --.

COLUMN 17

Line 7, "power" should read --powder--.
Line 9, "or" should read --or a--.
Line 14, "to to" should read --to--.

--

UNITED STATES PATENT AND TRADEMARK OFFICE

CERTIFICATE OF CORRECTION

PATENT NO. : 5,213,933

DATED : May 25, 1993

INVENTOR(S) : ICHIROU OSAKI, ET AL.

It is certified that error appears in the above-identified patent and that said Letters Patent is hereby corrected as shown below:

COLUMN 18

Line 31, "U" should be deleted.

COLUMN 23

Line 28, "30 7.5" should read --+7.5--.
Line 35, "was" should read --were--.

COLUMN 24

Line 40, "sometime" should read --sometimes--.
Line 58, "decreased" should read --decrease--.
Line 68, "added.of" should read --added. ¶ The obtained magnetic toner particles had a tribo-value of--.

COLUMN 25

Line 11, "same" should read --same method as that--.

COLUMN 26

Line 7, "same" should read --same method as that employed in Example 1 with the exception that--.

COLUMN 28

Line 16, "ester" should read --esters--.
Line 55, "$-CH_2-_nAr$," should read --$\leftarrow CH_2 \rightarrow_n Ar$,--.
Line 56, "anion" should read --anion.--.

--

UNITED STATES PATENT AND TRADEMARK OFFICE

CERTIFICATE OF CORRECTION

PATENT NO. : 5,213,933

DATED : May 25, 1993

INVENTOR(S) : ICHIROU OSAKI, ET AL.

It is certified that error appears in the above-identified patent and that said Letters Patent is hereby corrected as shown below:

COLUMN 29

Line 47, "$-CH_2-_nAr$," should read --$\leftarrow CH_2 \rightarrow_n Ar$,--.
Line 48, "analkyl" should read --an alkyl--.

COLUMN 30

Line 24, "atom" should read --atom,-- and "tom," should read --atom,--.
Line 25, "anion" should read --an anion--.

COLUMN 31

Line 43, "weight" should read --by weight--.
Line 63, "image;" should read --image,--.
Line 64, "said said" should read --said--.
Line 68, "polymer" should read --polymer or vinyl copolymer--.

COLUMN 32

Line 7, "monomer or" should read --monomer,--.
Line 8, "vinyl copolymer," should be deleted.
Line 17, "said said" should read --said--.
Line 56, "$-CH_2-_nAr$," should read --$\leftarrow CH_2 \rightarrow_n Ar$,-- and "AR" should read --Ar--.

COLUMN 33

Line 44, "$-CH_2-_nAr$," should read --$\leftarrow CH_2 \rightarrow_n Ar$,--.
Line 45, "aryl" should read --an aryl--.

--

UNITED STATES PATENT AND TRADEMARK OFFICE

CERTIFICATE OF CORRECTION

PATENT NO. : 5,213,933

DATED : May 25, 1993

INVENTOR(S) : ICHIROU OSAKI, ET AL.

It is certified that error appears in the above-identified patent and that said Letters Patent is hereby corrected as shown below:

COLUMN 34

Line 20, "atom" (first occurrence) should read --atom,--.
Line 21, "anion" should read --an anion--.

COLUMN 36

Line 55, "$-CH_2-_nAr$," should read --$\leftarrow CH_2 \rightarrow_n Ar$,--.

COLUMN 37

Line 47, "$-CH_2-_nAr$," should read --$\leftarrow CH_2 \rightarrow_n Ar$,--.
Line 48, "aryl" should read --an aryl--.

COLUMN 38

Line 23, "atom" (first occurrence) should read --atom,--.
Line 29, "fluoroboate" should read --fluoroborate--.

COLUMN 39

Line 45, "image:" should read --image;--.
Line 68, "mer" should read --mer or vinyl copolymer--.

COLUMN 40

Line 4, "of" (first occurrence) should be deleted.
Line 56, "$-CH_2-_nAr$," should read --$\leftarrow CH_2 \rightarrow_n Ar$,--.

COLUMN 41

Line 47, "$-CH_2-_nAr$," should read --$\leftarrow CH_2 \rightarrow_n Ar$,--.
Line 48, "aryl" should read --an aryl--.

--

UNITED STATES PATENT AND TRADEMARK OFFICE

CERTIFICATE OF CORRECTION

PATENT NO. : 5,213,933

DATED : May 25, 1993

INVENTOR(S) : ICHIROU OSAKI, ET AL. Page 7 of 8

It is certified that error appears in the above-identified patent and that said Letters Patent is hereby corrected as shown below:

COLUMN 42

Line 23, "atom" (first occurrence) should read --atom,--.
Line 24, "anion" should read --an anion--.

COLUMN 44

Line 1, "of" should be deleted.
Line 7, "tane," should read --thane,--.
Line 11, "0.1" should read --0.1 relative to 100 parts of the total weight of said components--.
Line 55, "$-CH_2-_nAr$," should read --$\leftarrow CH_2 \rightarrow_n Ar$,--.

COLUMN 45

Line 31, "claim 159," should read --claim 149,--.
Line 46, "$-CH_2-_nAr$," should read --$\leftarrow CH_2 \rightarrow_n Ar$,--.
Line 47, "aryl" should read --an aryl--.

COLUMN 46

Line 23, "atom" (first occurrence) should read --atom,--.
Line 24, "anion" should read --an anion--.
Line 27, "ions" (second occurrence) should read --ions,--.
Line 32, "formula:" should read
--formula:

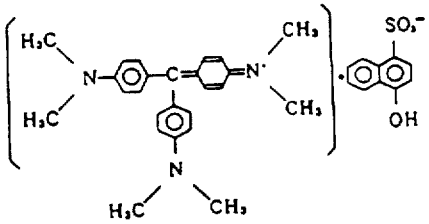

--.

UNITED STATES PATENT AND TRADEMARK OFFICE

CERTIFICATE OF CORRECTION

PATENT NO. : 5,213,933

DATED : May 25, 1993

INVENTOR(S) : ICHIROU OSAKI, ET AL.

It is certified that error appears in the above-identified patent and that said Letters Patent is hereby corrected as shown below:

COLUMN 47

Line 5, close up left margin.
Line 6, close up left margin.

Signed and Sealed this

Twelfth Day of April, 1994

Bruce Lehman

BRUCE LEHMAN

*Commissioner of Patents and Trademarks*

*Attest:*

*Attesting Officer*

--